US008708456B2

(12) United States Patent
Miyata

(10) Patent No.: US 8,708,456 B2
(45) Date of Patent: Apr. 29, 2014

(54) IMAGE FORMING APPARATUS

(75) Inventor: Tsuyoshi Miyata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 216 days.

(21) Appl. No.: 13/092,232

(22) Filed: Apr. 22, 2011

(65) Prior Publication Data

US 2011/0310172 A1 Dec. 22, 2011

(30) Foreign Application Priority Data

Jun. 22, 2010 (JP) ..... 2010-141967
Feb. 23, 2011 (JP) ..... 2011-036884

(51) Int. Cl.
*B41J 2/165* (2006.01)

(52) U.S. Cl.
USPC ..... 347/34

(58) Field of Classification Search
USPC ..... 347/34
See application file for complete search history.

(56) References Cited

U.S. PATENT DOCUMENTS 6,281,910 B1 * 8/2001 Nakano et al. ..... 347/34
2010/0026772 A1 2/2010 Miyata
2010/0201743 A1 8/2010 Miyata

FOREIGN PATENT DOCUMENTS

JP 2005-205766 8/2005
JP 2006-76155 3/2006
JP 2007-229950 9/2007
JP 2009262492 A * 11/2009

OTHER PUBLICATIONS

Machine translation of JP 2009-262492 A. (underlying document was published on Nov. 12, 2009).*

* cited by examiner

*Primary Examiner* — Justin Seo
(74) *Attorney, Agent, or Firm* — Cooper & Dunham LLP

(57) ABSTRACT

An image forming apparatus includes a carriage including a recording head that discharges liquid droplets for forming an image on a recording medium; a rail that supports the carriage in such a manner that the carriage reciprocates; a fixing part that fixes the rail; and an air stream creation part that creates an air stream. The fixing part is hollow, has a first inflow opening part and a discharge opening part, and the air stream created by the air stream creation part flows from the first opening part to the discharge opening part.

19 Claims, 19 Drawing Sheets

IMAGE FORMING APPARATUS

BACKGROUND OF THE INVENTION

1. Field of the Invention

The present invention relates to an image forming apparatus that forms an image onto a recording medium.

2. Description of the Related Art

In an image forming apparatus that carries out recording by discharging ink droplets from a recording head to a recording medium, there is a case where when ink droplets are discharged, satellite droplets may be produced behind ink droplets (main droplets) to be actually used for the recording, or ink mist may be produced when an ink droplets land on the recording medium and then bouncing occurs. Hereinafter, the satellite droplets, the ink mist, or such, will be generally referred to as "ink mist or such".

In the image forming apparatus, dummy discharge of ink may be carried out for the purpose of preventing nozzle surfaces of the recording head from being dried, or so. The dummy discharge may produce ink mist or such.

Ink mist or such may cause such a problem of dirtying the inside of the image forming apparatus, adhering to an operation mechanism part, and causing a malfunction in an image forming process of the image forming apparatus.

Further, in the image forming apparatus, a linear encoder and an encoder sensor may be provided as a position detection part that detects a position of the recording head with respect to the recording medium. In such a case, when ink mist or such adheres to the linear encoder or the encoder sensor, position detection performance of the position detection part may be degraded, or malfunction may occur.

It is noted that the position detection part including the linear encoder and the encoder sensor is such that, for example, scale information provided on the linear encoder that is fixed is optically or magnetically read by the encoder sensor that moves. Thus, it is possible to detect the position of the encoder sensor that moves with respect to the linear encoder that is fixed.

Further, when ink mist or such adheres to the nozzle surfaces of the recording head, mixing of inks of different colors, a phenomenon of ink being not discharged, or so may occur, and result in failure in printing.

In order to solve the problems, such a configuration has been proposed that dummy discharge reception parts, disposed on both sides in main scan directions of a carriage, and a drainage tank are connected together, and ink mist or such is led to the drainage tank by means of an air stream (see Japanese Laid-Open Patent Application No. 2006-76155).

Further, a suction hole is provided on the same surface of the nozzle surfaces of the recording head, a flexible duct that changes in its shape as a carriage moves and the suction hole are connected together, an air stream is created by a suction fan, and the air stream is used to collect ink mist or such (see Japanese Laid-Open Patent Application No. 2005-205766).

SUMMARY OF THE INVENTION

According to an embodiment of the present invention, an image forming apparatus includes a carriage in which a recording head that discharges liquid droplets to form an image onto a recording medium is provided; a rail that supports the carriage in such a manner that the carriage reciprocates; a fixing part that fixes the rail; and an air stream creation part that creates an air stream. The fixing part is hollow, and has a first inflow opening part and a discharge opening part.

The air stream created by the air stream creation part flows from the first inflow opening part to the discharge opening part.

Other objects, features and advantages of the present invention will become more apparent from the following detailed description when read in conjunction with the accompanying drawings.

DETAILED DESCRIPTION OF THE EMBODIMENTS

Figure 1:
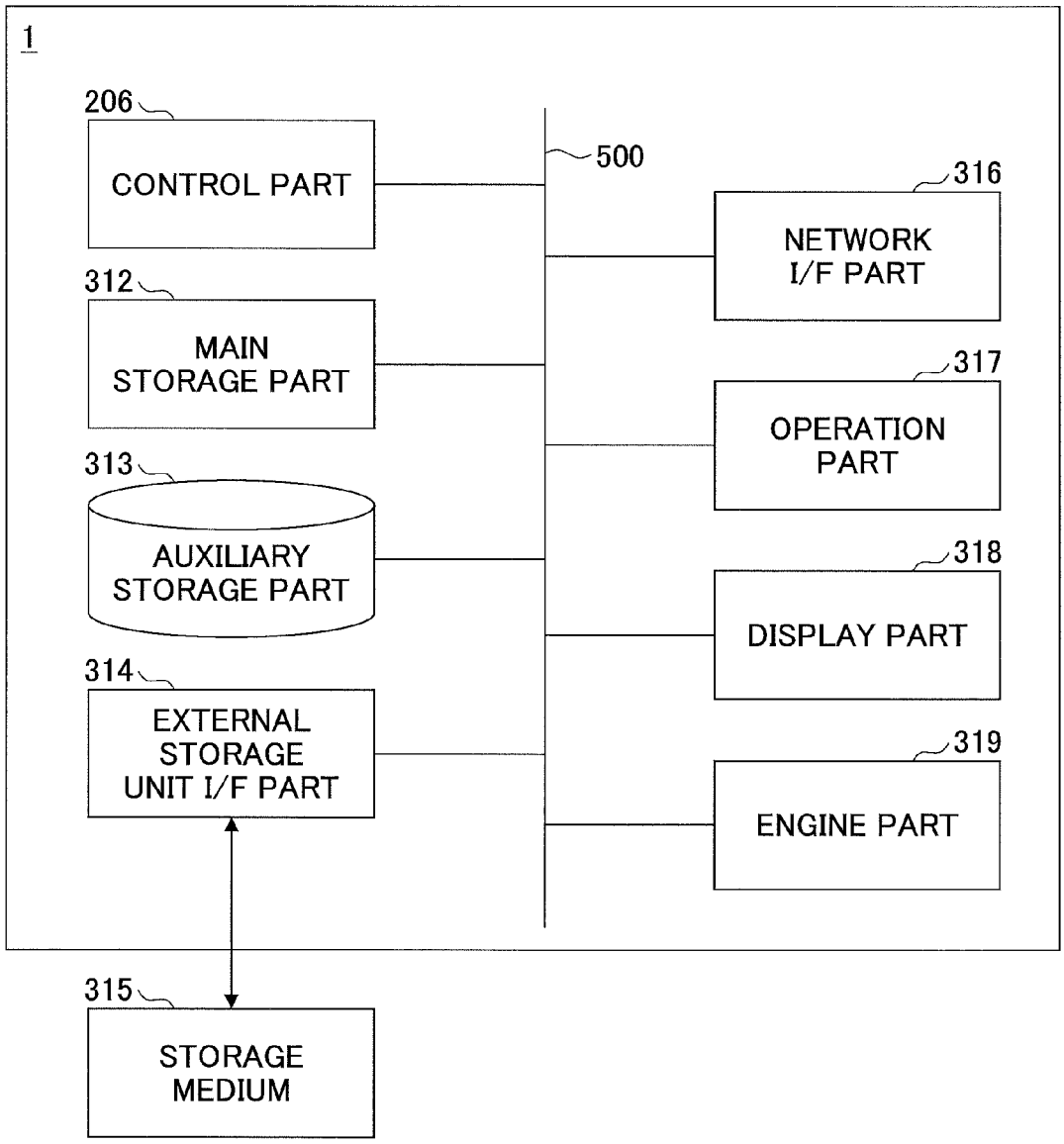
FIG. 1 shows a hardware configuration of an image forming apparatus according to an embodiment 1.

Before describing embodiments of the present invention, the problem in the related arts will be described first for the sake of convenience.

In the above-mentioned configurations of Japanese Laid-Open Patent Application No. 2006-76155 and Japanese Laid-Open Patent Application No. 2005-205766, ducts are provided to lead ink mist or such to a collection mechanism or the outside of the image forming apparatus by means of a created air stream. When the duct is thus provided, the size of the image forming apparatus may increase, and also, the costs may increase since the duct is additionally provided. When the size of the duct is reduced in order to solve the problem, it may not be possible to appropriately lead ink mist or such to the collection mechanism or the outside of the image forming apparatus.

According to embodiments of the present invention, in consideration of the above-mentioned problem, an object is to provide image forming apparatuses which collect ink mist or such without separately providing a duct.

Another object is to provide image forming apparatuses which effectively avoid adhesion of ink mist or such to a position detection part, which detects a position of a recording head with respect to a recording medium, or nozzle surfaces of the recording head.

Next, some terms will be described.

An image forming apparatus means, for example, a printer, a facsimile machine, a copier, a plotter, a MFP (MultiFunction Peripheral) which has respective functions of at least some of the printer, the facsimile machine, the copier, the plotter and so forth.

A recording medium means, for example, a medium such as paper, thread, fiber, leather, metal, plastic, glass, wood or ceramics. Below, such a recording medium will be referred to as paper.

To form an image means to give an image such as letters, figures, patterns, or such, to a recording medium, or to cause liquid (or ink) droplets to land onto a recording medium to form the above-mentioned image onto the recording medium.

"Liquid droplets" are used to generalize liquid droplets of all types of liquid that can be used to form the image such as liquid droplets of ink, recording liquid, fixing liquid, and so forth. For example, liquid droplets of DNA specimen, resist, pattern material, and so forth, are also referred to as liquid droplets. Below, liquid droplets will be referred to as ink droplets.

Further, below, liquid droplets will be described as including main liquid droplets and sub-liquid droplets. Main liquid droplets are liquid droplets that contribute to forming the image on paper (recording medium). Sub-liquid droplets are liquid droplets that do not contribute to forming the image on paper. For example, ink mist or such is included in sub-liquid droplets. Below, liquid droplets of ink mist or such will be referred to as sub-liquid droplets. Mechanisms of collecting sub-liquid droplets included in the image forming apparatuses according to the embodiment 1 and so forth collect sub-liquid droplets.

[Embodiment 1]

Next, the image forming apparatus according to the embodiment 1 will be described.

[Overall Hardware Configuration]

FIG. 1 shows a hardware configuration of the image forming apparatus 1 according to the embodiment 1. As shown in FIG. 1, the image forming apparatus 1 includes a control part 206, a main storage part 312, an auxiliary storage part 313, an external storage unit I/F (InterFace) part 314, a network I/F part 316, an operation part 317, a display part 318 and an engine part 319. These components are connected by a bus 500.

The control part 206 includes a CPU (Central Processing Unit) that controls the other components, and carries out calculation and modification of data in the computer. Further, the control part 206 acts as an arithmetic and logic unit that executes programs stored in the main storage part 312, receives data from the operation part 317, the main storage part 312, the auxiliary storage part 313 and/or a storage medium 315 through the external storage unit I/F part 314, and, after calculation and/or modification of the data, outputs the data as a result of the calculation and/or modification to the display part 318, the engine part 319, the main storage part 312, the auxiliary storage part 313 and/or the storage medium 315 through the external storage unit I/F part 314.

The main storage part 312 includes a ROM (Read Only Memory), a RAM (Random Access Memory) or such, and acts as a storage unit that stores or temporarily holds the programs that the control part 206 executes, such as an OS (Operating System) that is basic software, application software and so forth, and/or data.

The auxiliary storage part 313 includes a HDD (Hard Disk Drive) or such, and is a storage unit that stores data concerning the application software or such. The external storage unit I/F part 314 provides an interface between the storage medium 315 (for example, a flash memory) connected through a data transmission path such as a USB (Universal Serial Bus) and the image forming apparatus 1.

Further, a given program may be stored in the storage medium 315, the given program stored in the storage medium 315 may be then installed in the image forming apparatus 1 through the external storage unit I/F part 314, and the image forming apparatus 1 may execute the installed given program.

The network I/F part 316 provides an interface between a peripheral device, having a communication function and connected through a communication network such as a LAN (Local Area Network) or a WAN (Wide Area Network) which is established by using a data transmission path such as a wire and/or wireless line, and the image forming apparatus 1.

The operation part 317 and the display part 318 include key switches (hardware keys) and a LCD (Liquid Crystal Display) including a touch panel function (including software keys of a GUI (Graphical User Interface)), and is a display and/or input unit acting as a UI (User Interface) to be used when the functions of the image forming apparatus 1 are used by the user.

In the engine part 319, mechanism parts such as a plotter or a printer which carries out a process concerning actually forming an image, a scanner, respective motors, and so forth, are driven.

[Overall Configuration]

Figure 2:
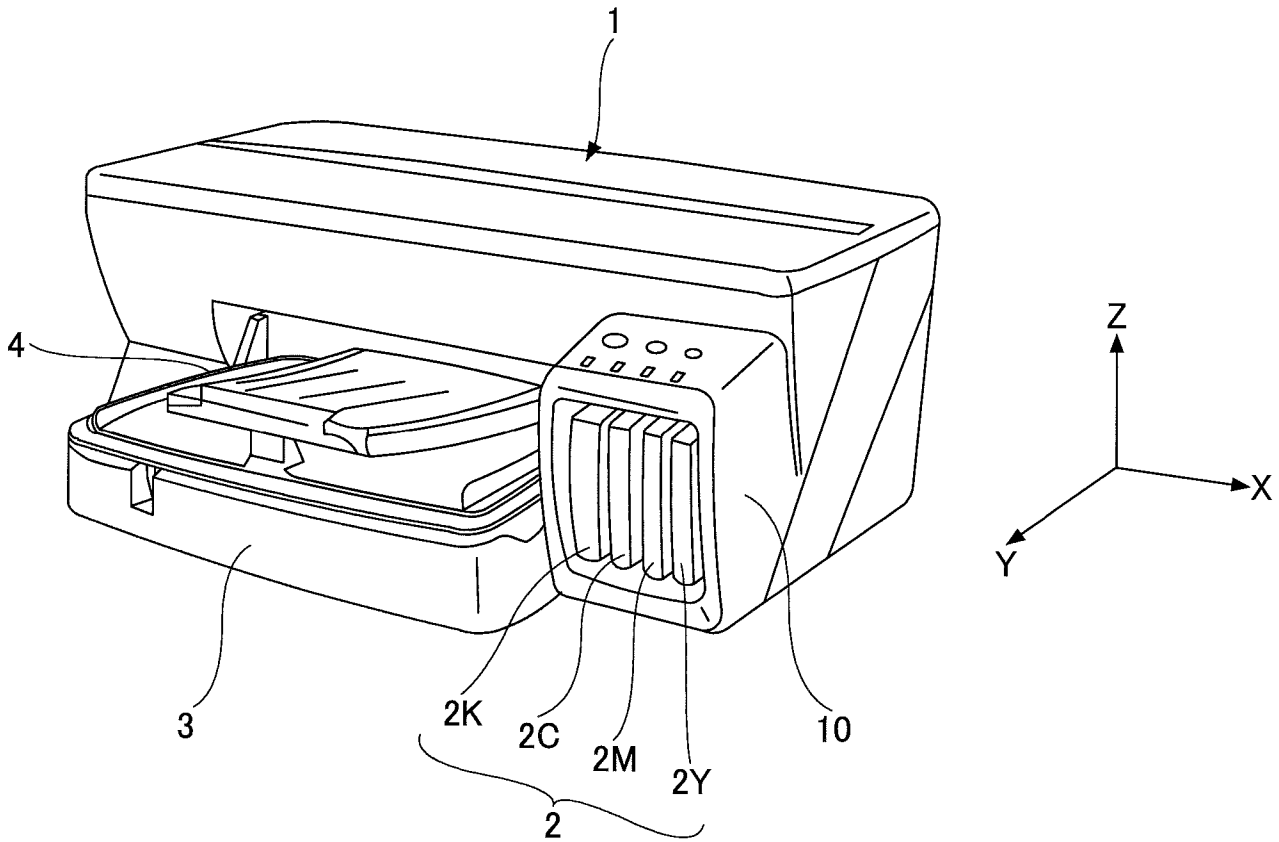
FIG. 2 shows an external perspective view of the image forming apparatus according to the embodiment 1.

FIG. 2 shows an external perspective view of the image forming apparatus 1 according to the embodiment 1. As shown in FIG. 2, an ink cartridge loading part 10 is provided at a bottom right position of a front side part of the image forming apparatus 1. As shown in FIG. 2, the image forming apparatus 1 according to the embodiment 1 is, for example, an ink jet recording apparatus. In the ink cartridge loading part 10, ink cartridges 2 are loaded. The user may remove the ink cartridge 2 that has become empty from the ink cartridge loading part 10, and replace it by a new one. In the example of FIG. 2, the ink cartridges 2 include a black ink cartridge 2K, a cyan ink cartridge 2C, a magenta ink cartridge 2M and a yellow ink cartridge 2Y.

Further, a paper feeding tray 3 is provided at a bottom position of the image forming apparatus 1, and paper may be supplied to the image forming apparatus 1 by using the paper feeding tray 3. Further, a paper ejection tray 4 is provided above the paper feeding tray 3, and paper for which printing has been finished is ejected to the paper ejection tray 3. Further, width directions of the image forming apparatus 1 are referred to as X-axis directions, front and back directions in which paper is ejected are referred to as Y-axis directions and vertical directions of the image forming apparatus 1 are referred to as Z-axis directions.

Figure 3:
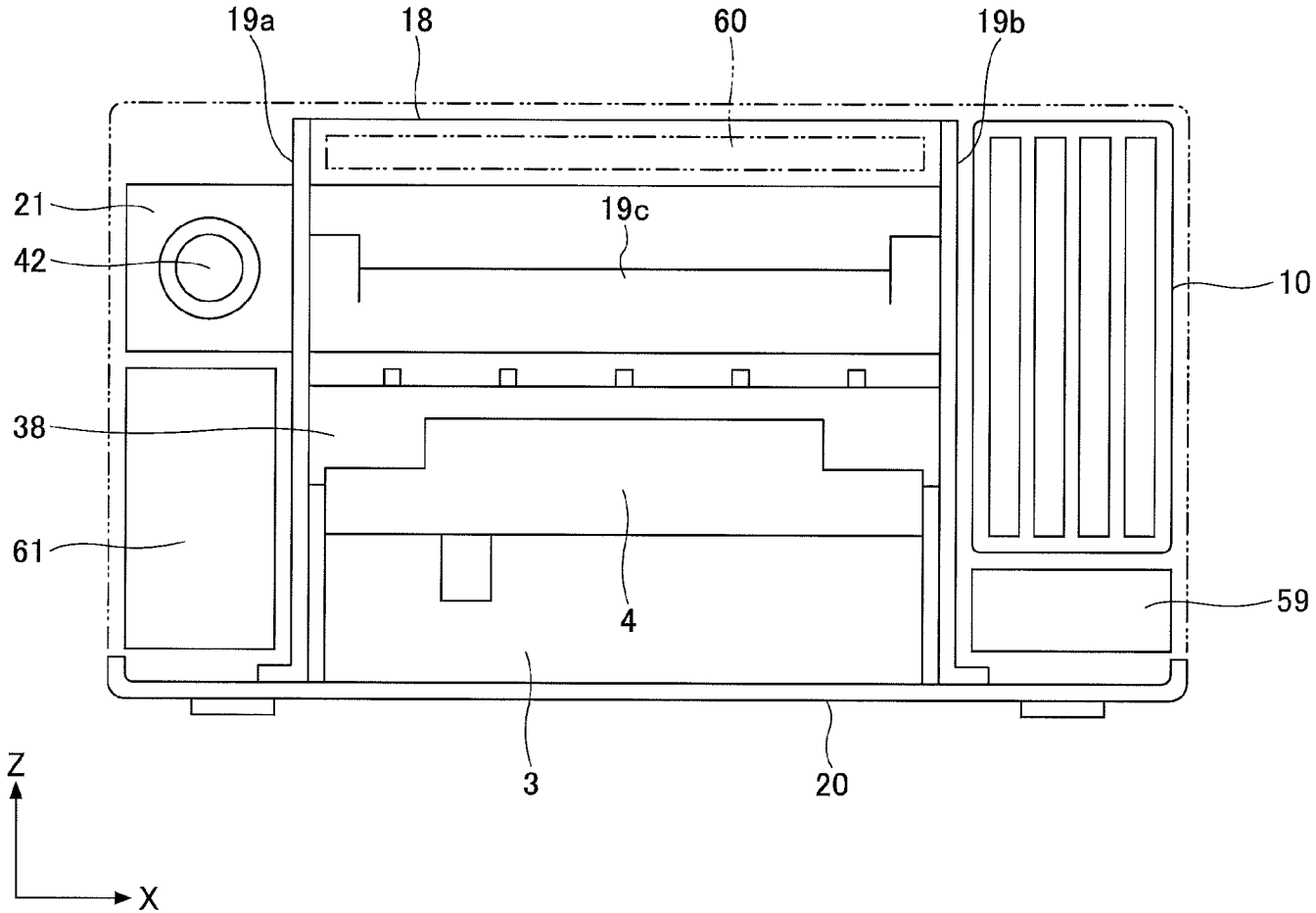
FIG. 3 shows a front internal view of the image forming apparatus according to the embodiment 1.
Figure 4:
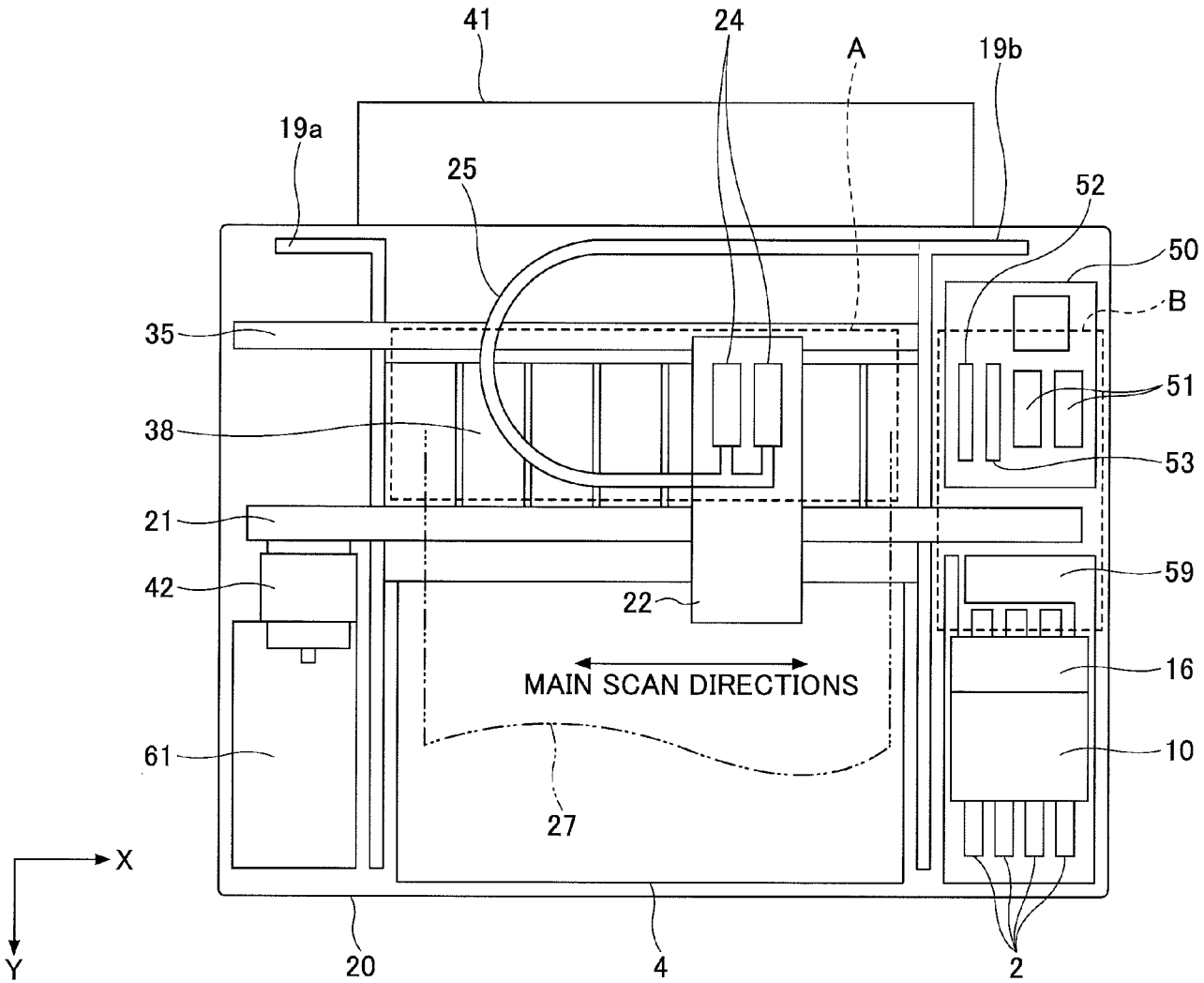
FIG. 4 shows a plan internal view of the image forming apparatus according to the embodiment 1.
Figure 5:
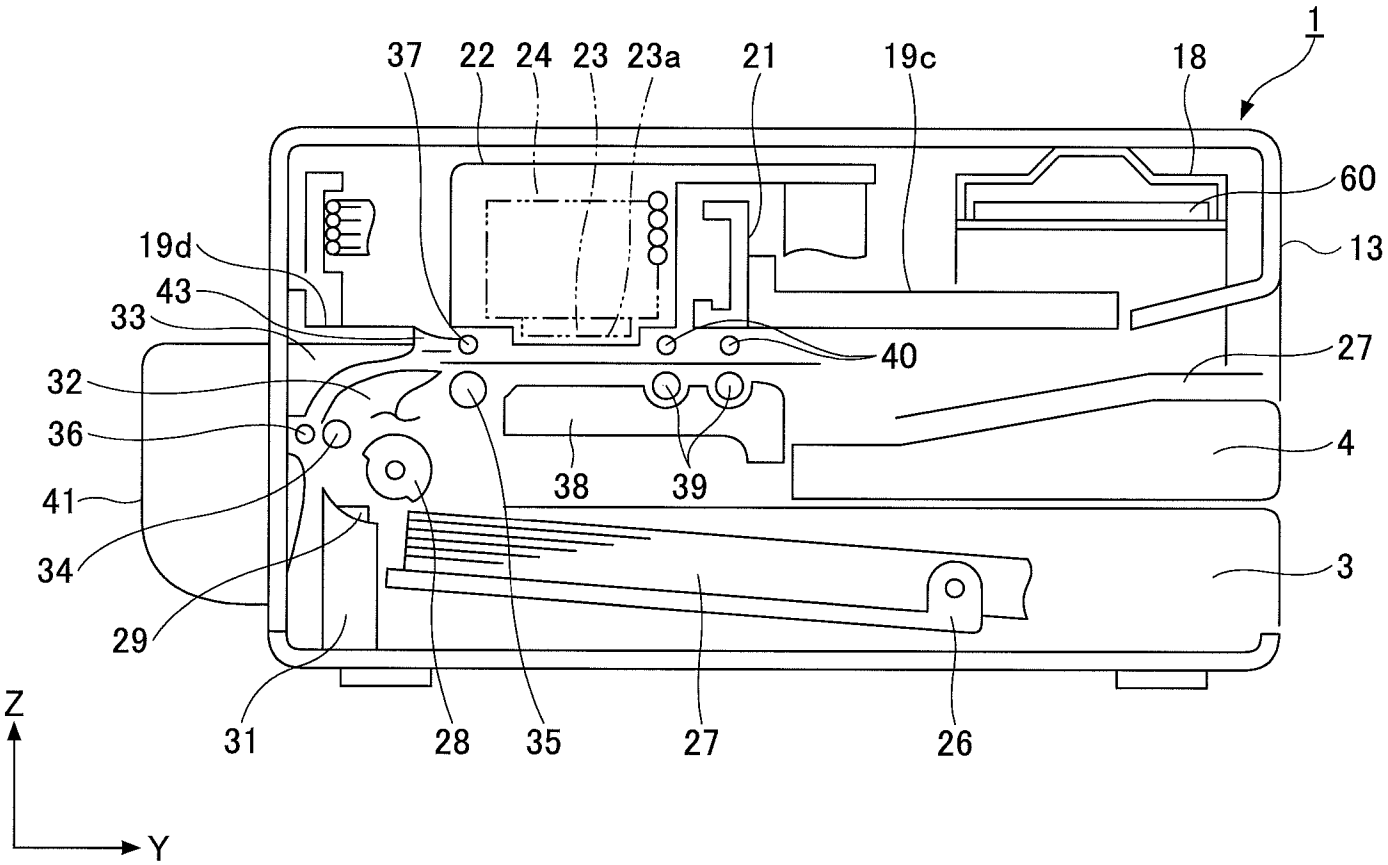
FIG. 5 shows a side internal view of the image forming apparatus according to the embodiment 1.

FIG. 3 shows a partial sectional view of the image forming apparatus 1 viewed from a position directly in front of the image forming apparatus 1. FIG. 4 shows a partial sectional view of the image forming apparatus 1 viewed from a position right above the image forming apparatus 1. FIG. 5 shows a partial sectional view of the image forming apparatus 1 viewed from a position right beside the image forming apparatus 1. Further, below, directions in which a carriage 22 shown in FIG. 4 moves will be referred to as main scan directions (see FIG. 4) and directions in which paper is conveyed will be referred to as sub-scan directions.

In the carriage 22, two recording heads 23 (see FIG. 5) are installed. The two recording heads 23 are arranged in the main scan directions. Ink discharge ports 23*a* of liquid droplet discharge heads included in the recording heads 23 (see FIG. 5) are arranged in the sub-scan directions to form two lines, and the liquid droplet discharge heads are installed in such a manner that their ink discharge directions correspond to the downward direction. The total four lines of ink discharge ports 23*a* discharge ink droplets of respective colors of yellow (Y), cyan (C), magenta (M) and black (Bk).

The recording heads 23 may include, as a pressure generation part that generates pressure to discharge liquid droplets (i.e., ink droplets), thermal actuators that use electrothermal conversion devices such as heat elements and use phase change caused by film boiling of liquid, shape memory alloy actuators that use metal phase change caused by temperature change, electrostatic actuators that use electrostatic force, or such.

Further, in the carriage 22, head tanks (i.e., sub-tanks) 24 of the respective colors, acting as second liquid containing parts, are installed for supplying the inks of the respective colors to the respective recording heads 23. In the ink cartridge loading part 10, the ink cartridges 2 are loaded. The inks are supplied to the head tanks 24 of the respective colors through supply tubes 25 of the respective colors having flexibility from the ink cartridges 2 of the respective colors. In the ink cartridge loading part 10, a supply pump unit 16 is provided which acts as a liquid feeding part for feeding the inks from the ink cartridges 2. It is noted that intermediate parts of the supply tubes 25 are supported by a holding member provided above a back supporting member 19*d* (see FIG. 5).

Near the paper feeding tray 3, a semicircular roller (or paper feeding roller) 28 and a separation pad 29 are provided to face one another (see FIG. 5).

Below, as shown in FIG. 4, a zone at which paper onto which an image is formed by the recording heads 23 is placed will be referred to as an image forming zone A, and a route extending from the paper feeding tray 3 to the image forming zone A will be referred to as a paper route. In other words, the image forming zone A is a zone above a platen 38 which will be described later.

The semicircular roller 28 shown in FIG. 5 separates and feeds paper 27, sheet by sheet, from a stack part 26 of the paper feeding tray 3. The separation pad 29 made of material having high coefficient of friction is pressed toward the semicircular roller 28. Further, on the way of the paper route, guide members 31, 32, 33, and a holding member 43 having conveyance rollers 34, 35, a counter roller 36 and a pressing roller 37, are disposed.

The separated and fed paper 27 is led by the guide members 31, 32 and 33. The paper 27 is conveyed by being sandwiched by the conveyance roller 34 and the counter roller 36. On the further downstream side, the paper 27 is conveyed by being sandwiched by the conveyance roller 35 and the pressing roller 37, and thus, the conveyance direction is changed. Thus, the paper 27 is fed to the image forming zone A.

Then, when the control part 206 recognizes that the paper 27 has reached the image forming zone A, the control part 206 drives the recording heads 23 according to a given image signal. As thus being driven, the recording heads 23 discharge ink droplets onto the paper 27 that stands still on the platen 38 (i.e., is placed in the image forming zone A) to carry out recording for one line, and then carry out recording for another line after the paper 27 is conveyed for a predetermined amount. Then, when the control part 206 receives a recording end signal or a signal indicating that the tail end of the paper 27 has reached the image forming zone A, the control part 206 finishes the image forming process.

When the image forming process is finished, the paper 27 is conveyed to the paper ejection tray 4. Paper ejection rollers 39 and paper ejection spurs 40 are provided to eject the paper 27 to the paper ejection tray 4. The paper 27 for which the image forming process has been finished is thus conveyed to the paper rejection tray 4 by being sandwiched by the paper ejection rollers 39 and paper ejection spurs 40.

Further, in a back side part of the image forming apparatus 1, a both-sides unit 41 is detachably loaded. The both-sides unit 41 receives the paper 27 that has been returned as a result of the conveyance roller 35 being rotated in the reverse direction, and again feeds the received paper 27 into a nip between the conveyance roller 34 and the counter roller 36. Further, above the both-sides unit 41, a hand paper insertion tray (not shown) is provided.

Further, in a non-printing zone on one side of the carriage 22 in the main scan directions, a maintenance and recovery mechanism 50 including a part configured to maintain and recover proper states of the nozzles of the recording heads 23 is provided (see FIG. 4).

The maintenance and recovery mechanism 50 includes cap members (hereinafter referred to as "caps") 51, a wiper blade 52, and a dummy discharge receiver 53. The caps 51 cap the nozzle surfaces of the recording heads 23. The wiper blade 52 wipes the nozzle surfaces. The dummy discharge receiver 53 receives ink that has been discharged for the purpose of discharging thickened ink.

The ink produced through the maintenance and recovery operation of the maintenance and recovery mechanism 50, the ink discharged to the caps 51, the ink adhered to the wiper blade 52 and removed by a wiper cleaner (not shown) and the ink discharged to the dummy discharge receiver 53 are discharged to a drainage tank 59 and are thus collected there.

During a state of waiting for printing in the image forming apparatus 1, the carriage 22 moves to the maintenance and recovery mechanism 50, the caps 51 cap the nozzle surfaces of the recording heads 23, the nozzles are maintained in a wet condition, and thus, it is possible to avoid a failure where the recording heads 23 cannot discharge the ink because the ink has been dried in the nozzles. Further, in a state in which the nozzles of the recording heads 23 are capped by the caps 51, the ink is suctioned from the nozzles by means of a suction pump not shown (referred to as "nozzle suction" or "head suction"), and thus, a recovery operation is carried out where the thickened ink or air bubbles are discharged. Thereby, the stable ink droplet discharge performance of the recording heads 23 is maintained. Further, as shown in FIG. 4, a zone at which the ink droplet discharge performance of the recording heads 23 is recovered by the maintenance and recovery mechanism 50 is referred to as a recovery zone B.

Further, as shown in FIG. 3, a main frame of the image forming apparatus 1 according to the embodiment 1 includes a base 20 supporting the bottom side of the image forming apparatus 1, left and right main side plates 19*a* and 19*b*, a fixing part 19*c* that connects the left and right main side plates 19*a* and 19*b*, and the back supporting member 19*d*. Below, the fixing part 19*c* will be referred to as a rail supporting member 19*c*. It is noted that the back supporting member 19*d* is shown in FIG. 5. As shown in FIG. 5, the image forming apparatus 1 has a cover 13.

By a rail 21 supported by the rail supporting member 19*c*, the carriage 22 is supported in such a manner as being movable in the main scan directions. The carriage 22 reciprocates in the main scan directions driven by a main scan motor 42 (see FIG. 4) through a timing belt (not shown).

Further, the platen 38 supports the paper 27 at the image forming zone (or printing zone) A. The platen 38 is disposed at a position to face the recording heads 23. The platen 38 is supported by the left and right main side plates 19*a* and 19*b*.

Figure 6:
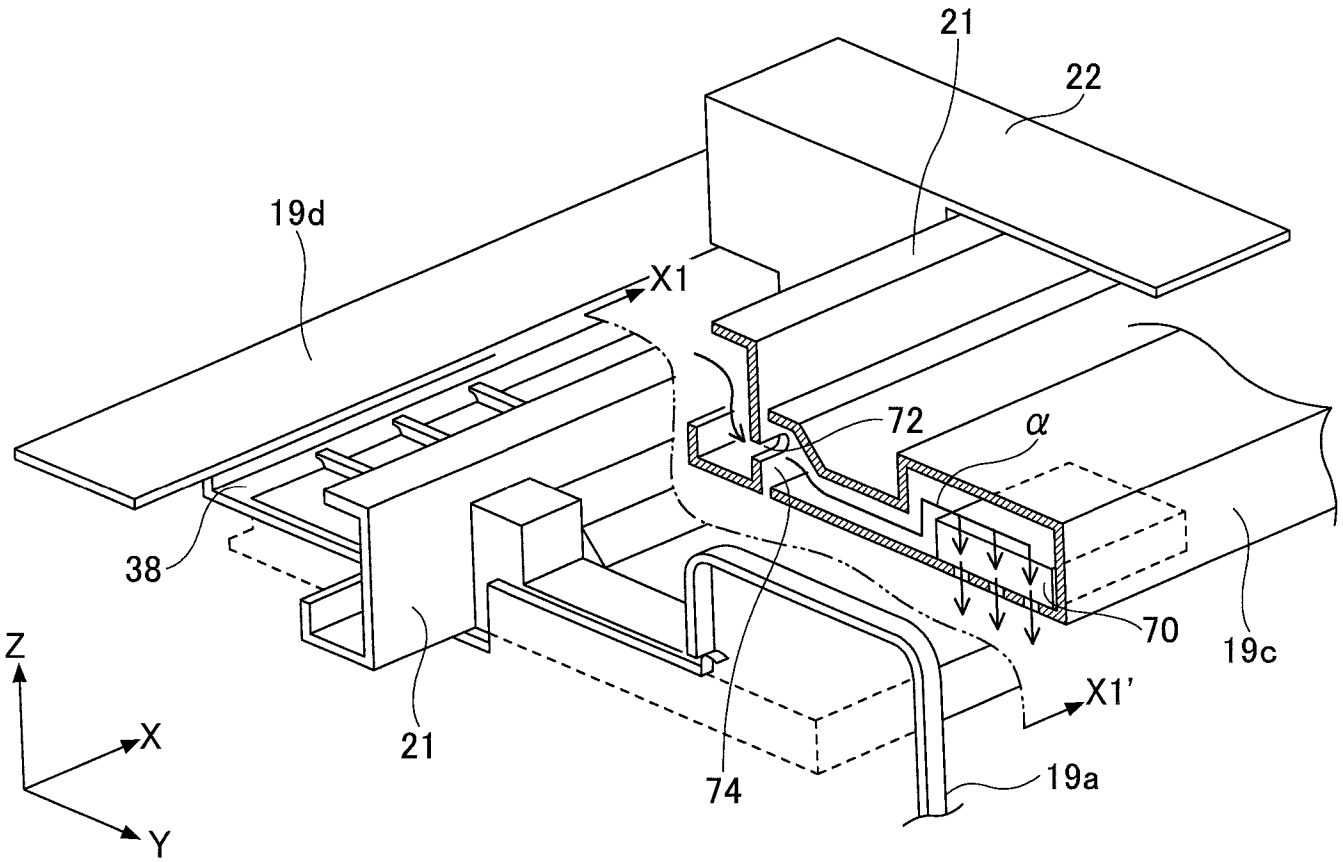
FIG. 6 shows a partial perspective view of the image forming apparatus according to the embodiment 1.
Figure 7:
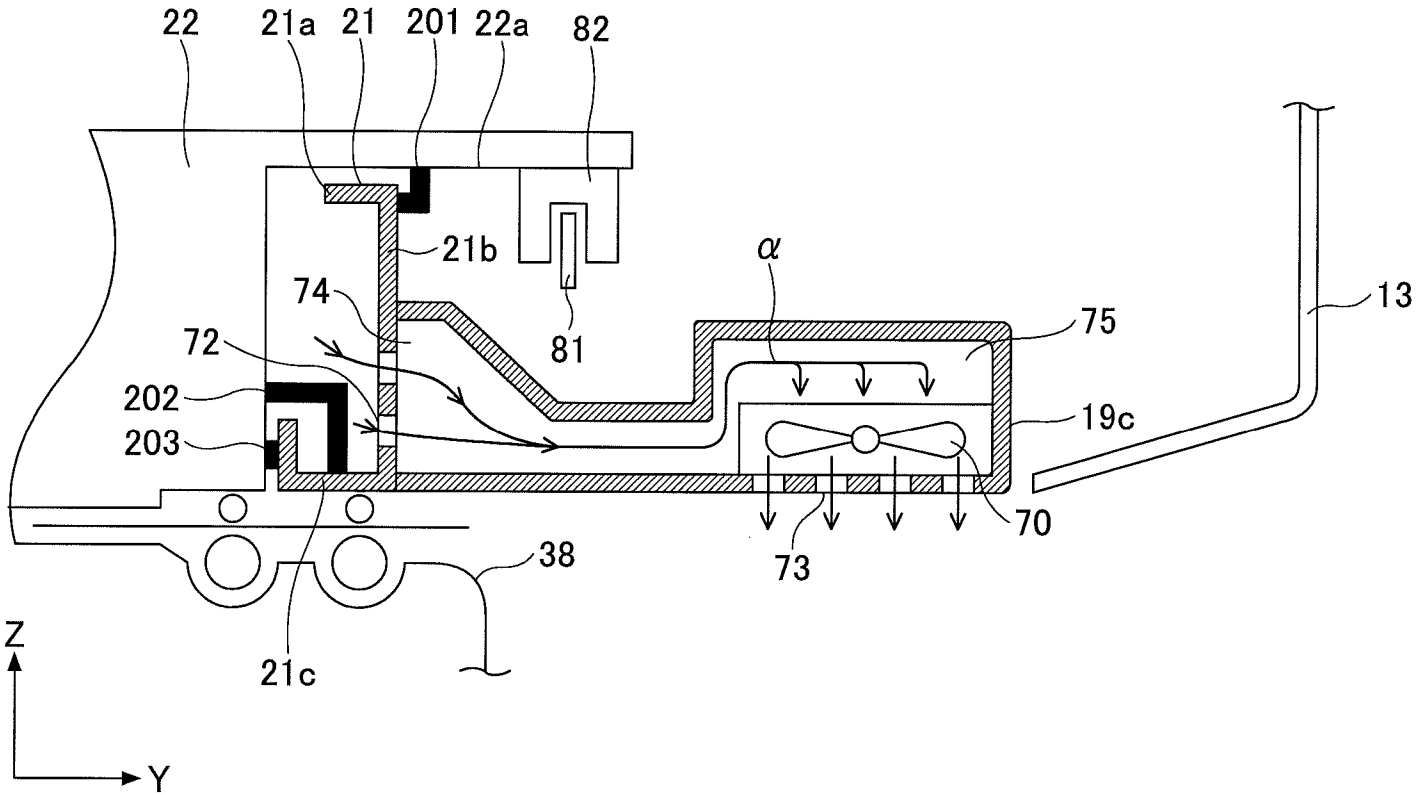
FIG. 7 shows a partial side sectional view of the image forming apparatus according to the embodiment 1.

Next, a mechanism of collecting sub-liquid droplets (which may be hereinafter simply referred to as "collection mechanism") of the image forming apparatus 1 according to the embodiment 1 will be described in detail. FIG. 6 shows a perspective view of the collection mechanism, and FIG. 7 shows a partial side sectional view of the collection mechanism. For the sake of convenience for describing the configuration of the collection mechanism, in FIG. 6, a state where the rail 21 and the rail supporting member 19*c* are cut by a plane parallel to both the Y-axis directions and the Z-axis directions is shown on the X1-X1' side of an alternate long and two short dashed line. In the example shown in FIGS. 6 and 7, the rail 21 has a sectional shape like approximately "C". Between a top side 21*a* of the rail 21 and a bottom side 22*a* of the carriage 22, a predetermined space is provided (see FIG. 7). Further, the carriage 22 moves in the main scan directions (i.e., X-axis directions, i.e., front and back directions in FIG. 7) as being slidably supported by the rail 21 through a rotation preventing member 201, a first contacting member 202 and a second contacting member 203. It is noted that the rotation preventing member 201, the first contacting member 202 and the second contacting member 203 are attached to the carriage 22.

The rotation preventing member 201 has a sectional shape like approximately "L", and is a member to prevent tilting (or rotation) of the carriage 22 otherwise occurring because of the weight of the carriage 22. The first contacting member 202 has a sectional shape like approximately "L" and is a member to prevent movement of the carriage 22 in the Z-axis directions. The second contacting member 202 prevents movement of the carriage 22 in the Y-axis directions.

On the back side (i.e., the right side in FIG. 7) of the rail 21, a linear encoder 81 is provided, which is an extending part of a position detection part that detects a position of the carriage 22 in the main scan directions, and the carriage 22 has an encoder sensor 82 that is a detection part of the position detection part. Thus, the linear encoder 81 and the encoder sensor 82 are included in the position detection part.

Further, a fixing plate 21*b* of the rail 21 and the rail supporting member 19*c* are connected, and thus, the rail 21 is fixed to the rail supporting member 19*c*. Further, as shown in FIG. 7, the platen 38 is disposed below a bottom plate 21*c* of the rail 21. Further, the fixing plate 21*b* has second inflow opening parts 72 that are openings through which the left side space of the rail 21 communicates with the back side (right side) space of the rail 21.

According to the embodiment 1, the rail supporting member 19*c* is hollow (or has a cavity), i.e., has a cavity part (i.e., a space) 75, as shown in FIG. 7. The rail supporting member 19*c* has a first inflow opening part 74 that is an opening through which the cavity part 75 communicates with the left side of the rail supporting member 19*c* in FIG. 7, and discharge opening parts 73 that are openings through which the cavity part 75 communicates with the lower side of the rail supporting member 19*c* in FIG. 7. Further, the second inflow opening parts 72 and the first inflow opening part 74 are connected as shown in FIG. 7. Accordingly, an air route such as the second inflow opening parts 72→the first inflow opening part 74→the cavity part 75→the discharge opening parts 73 (hereinafter, simply referred to as an air route). Thus, air flowing from the second inflow opening parts 72 is discharged from the discharge opening parts 73. At this time, as can be seen from FIG. 7, a part of the air route is formed (defined) by a part of a vertical wall surface of the fixing plate 21*b* of the rail 21, which part faces the first inflow opening part 74.

Further, the image forming apparatus 1 according to the embodiment 1 has a air stream creation part 70. The air stream creation part 70 is controlled by the control part 206 and creates an air stream α (see FIG. 7). The air stream creation part 70 is driven to create the air stream α (air) being discharged from the discharge opening parts 73. The air stream creation part 70 is, for example, a fan. In the case where the air stream creation part 70 is a fan, an impeller of the fan is rotated by a motor (not shown), and thereby, the air stream α is created. By the air stream creation part 70, the air stream α is created in the inside (i.e., in the cavity part 75) of the fixing part 19*c* (i.e., the rail supporting part). The air stream α is an air stream with flow route such as the second inflow opening parts 72→the first inflow opening part 74→the cavity part 75→the discharge opening parts 73.

Further, as shown in FIGS. 6 and 7, it is preferable that the air stream creation part 70 is provided in the inside of the rail supporting part 19*c*. This is because it is possible to further miniaturize the image forming apparatus 1.

Further, it is preferable that the second inflow opening parts 72 are provided near the recovery zone B and/or the image forming zone A (see FIG. 4). In the recovery zone B, the dummy discharge of ink is carried out when the maintenance and recovery operation for the recording heads 23 is carried out as mentioned above. Therefore, by providing the second inflow opening parts 72 near the recovery zone B, the sub-liquid droplets produced by the dummy discharge are effectively caused to flow into the cavity part 75 through the second inflows opening parts 72 and the first inflow opening part 74, and then are discharged from the discharge opening parts 73.

Further, by providing the second inflow opening parts 72 near the image forming zone A, the sub-liquid droplets produced through the image forming process carried out by the recording heads 23 are effectively caused to flow into the cavity part 75 through the second inflow opening parts 72 and the first inflow opening part 74, and then are discharged from the discharge opening parts 73. The sub-liquid droplets thus discharged from the discharge opening parts 73 are then discharged to the outside of the image forming apparatus 1.

Thus, in the image forming apparatus 1 according to the embodiment 1, the rail supporting member 19*c* plays a role of fixing the rail 21 in the image forming apparatus 1. Further, the rail supporting part 19*c* is hollow, and thus also acts as a duct. Accordingly, it is possible to reduce the size of the image forming apparatus 1 since it is not necessary to separately provide a duct, and instead, the rail supporting member 19*c* is used as the duct. Further, because it is not necessary to separately provide a duct, it is possible to provide the collection mechanism of collecting the sub-liquid droplets at low cost. The collection mechanism according to the embodiment 1 includes the rail 21, the rail supporting member 19*c* and the air stream creation part 70.

Further, by providing the second inflow opening parts 72 near the recovery zone B and/or the image forming zone A where the sub-liquid droplets are produced, it is possible to effectively collects the sub-liquid droplets. Accordingly, it is possible to avoid diffusion of the sub-liquid droplets (for example, ink mist or such), and discharge them efficiently.

Further, when the second inflow opening parts 72 are provided throughout the main scan range of the carriage 22 (i.e., the whole range of the carriage 22 moving), this means that the second inflow opening parts 72 are provided for both the recovery zone B and the image forming zone A.

Further, according to the embodiment 1, the second inflow opening parts 72 are formed in the rail 21 for the purpose of causing the sub-liquid droplets to flow into the first inflow opening part 74. However, another method may be used without forming the second inflow opening parts 72 in the rail 21 as long as it is possible to cause the sub-liquid droplets to flow into the first inflow opening part 74.

[Embodiment 2]

Next, an image forming apparatus according to an embodiment 2 of the present invention will be described. The image forming apparatus according to the embodiment 2 has a configuration similar to that of the image forming apparatus 1 according to the embodiment 1 described above. Below, description will be made in a manner of focusing on points different from the image forming apparatus according to the embodiment 1, and duplicate description will be omitted as is appropriate.

Generally speaking, a radiation member that radiates heat is included in an image forming apparatus. The radiation member is, for example, a control substrate. When heat thus radiated stays in the image forming apparatus, various members such as a belt expand, which may make it not possible to carry out an image forming process appropriately. The embodiment 2 solves the problem.

Figure 8:
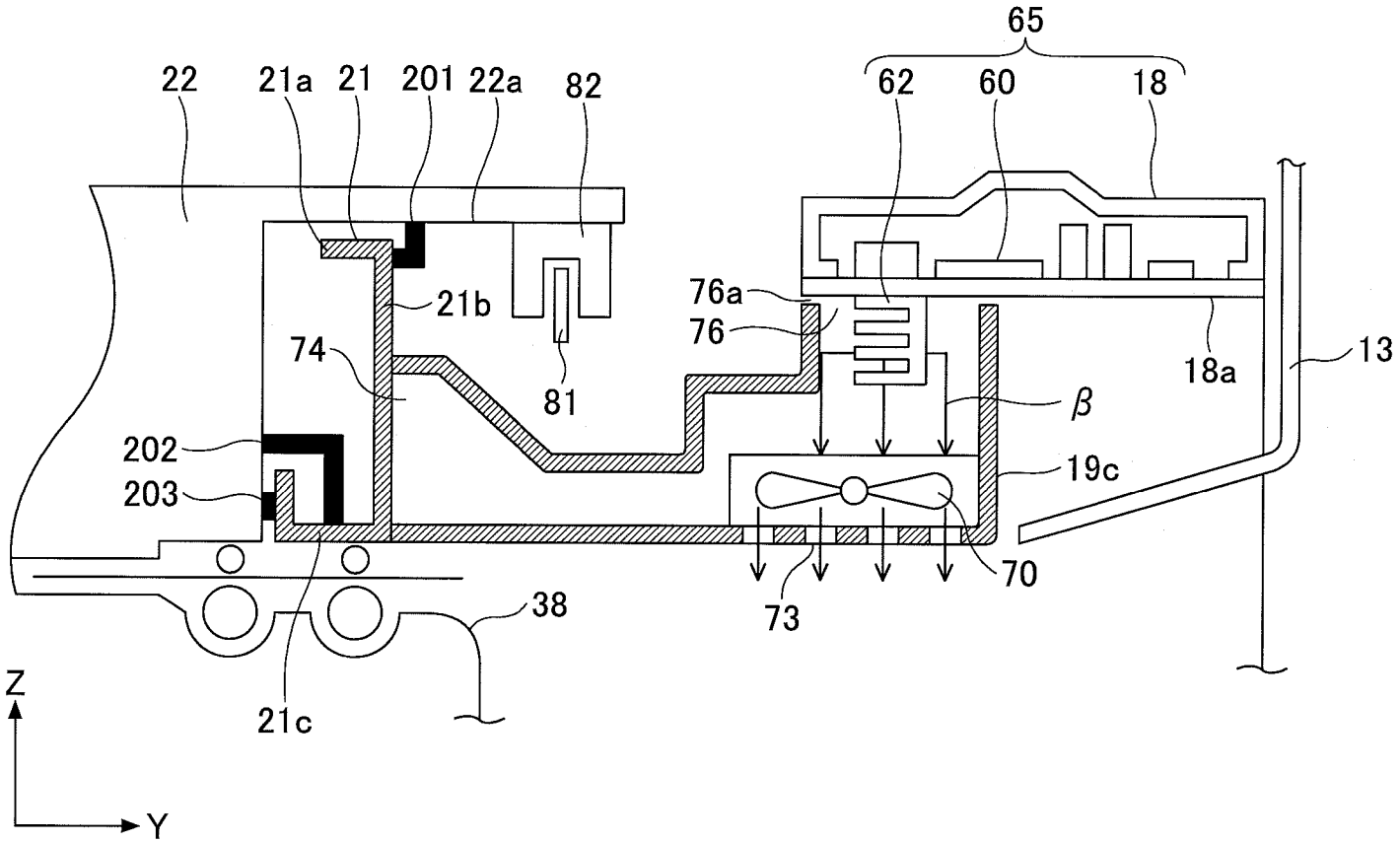
FIG. 8 shows a partial side sectional view of an image forming apparatus according to an embodiment 2.

FIG. 8 shows a partial side sectional view of the image forming apparatus according to the embodiment 2. In the image forming apparatus according to the embodiment 2, a third inflow opening part 76 is provided which is an opening through which the inside of the rail supporting member 19*c* communicates with the upper side of the rail supporting member 19*c* as shown in FIG. 8. Further, a space (or gap) 76*a* is provided between the rail supporting member 19*c* and a bottom plate 18*a* of a control substrate bracket 18 in the periphery of the third inflow opening part 76.

Further, above the rail supporting member 19*c*, a radiation member 65 is disposed. In the example of FIG. 8, the radiation member 65 includes the control substrate bracket 18, a control substrate 60 and a radiation plate 62. It is noted that on the control substrate 70, a control circuit that realizes the function of the control part 206 shown in FIG. 1 is provided, for example.

In the inside of the control substrate bracket 18, the control substrate 60 is disposed. Further, on the bottom plate 18*a* of the control substrate bracket 18, the radiation plate 62 is disposed. Further, the radiation plate 62 is disposed in such a manner to project from the third inflow opening part 76 to the inside of the rail supporting member 19*c*. Heat radiated from the control substrate 60 is then radiated from the radiation plate 62.

Further, the air stream creation part 70 creates an air stream β flowing along such a path as the space 76*a*→the third inflow opening part 76→the discharge opening part 73. That is, air flowing from the third inflow opening part 76 through the space 76*a* is discharged from the discharge opening part 73. Thereby, the heat transferred from the control substrate 60 flows from the third inflow opening part 76 and is discharged from the discharge opening part 73, by heating the air stream β.

In the image forming apparatus according to the embodiment 2, it is possible to appropriately discharge the heat radiated from the radiation member 65 without providing a special duct. Therefore, it is possible to prevent the heat from the radiation member 65 from staying in the image forming apparatus.

[Embodiment 3]

Next, an image forming apparatus according to an embodiment 3 of the present invention will be described. The image forming apparatus according to the embodiment 3 has a configuration similar to that of the image forming apparatus 1 according to the embodiment 1 described above. Below, description will be made in a manner of focusing on points different from the image forming apparatus according to the embodiment 1, and duplicate description will be omitted as is appropriate.

The image forming apparatus according to the embodiment 3 has a feature that is a combination of the respective features of the image forming apparatus according to the embodiment 1 and the image forming apparatus according to the embodiment 2 described above. That is, the configuration (described above for the embodiment 1) of discharging the sub-liquid droplets produced from the image forming process or the dummy discharge process, and the configuration (described above for the embodiment 2) of discharging the heat radiated from the radiation member are combined.

Figure 9:
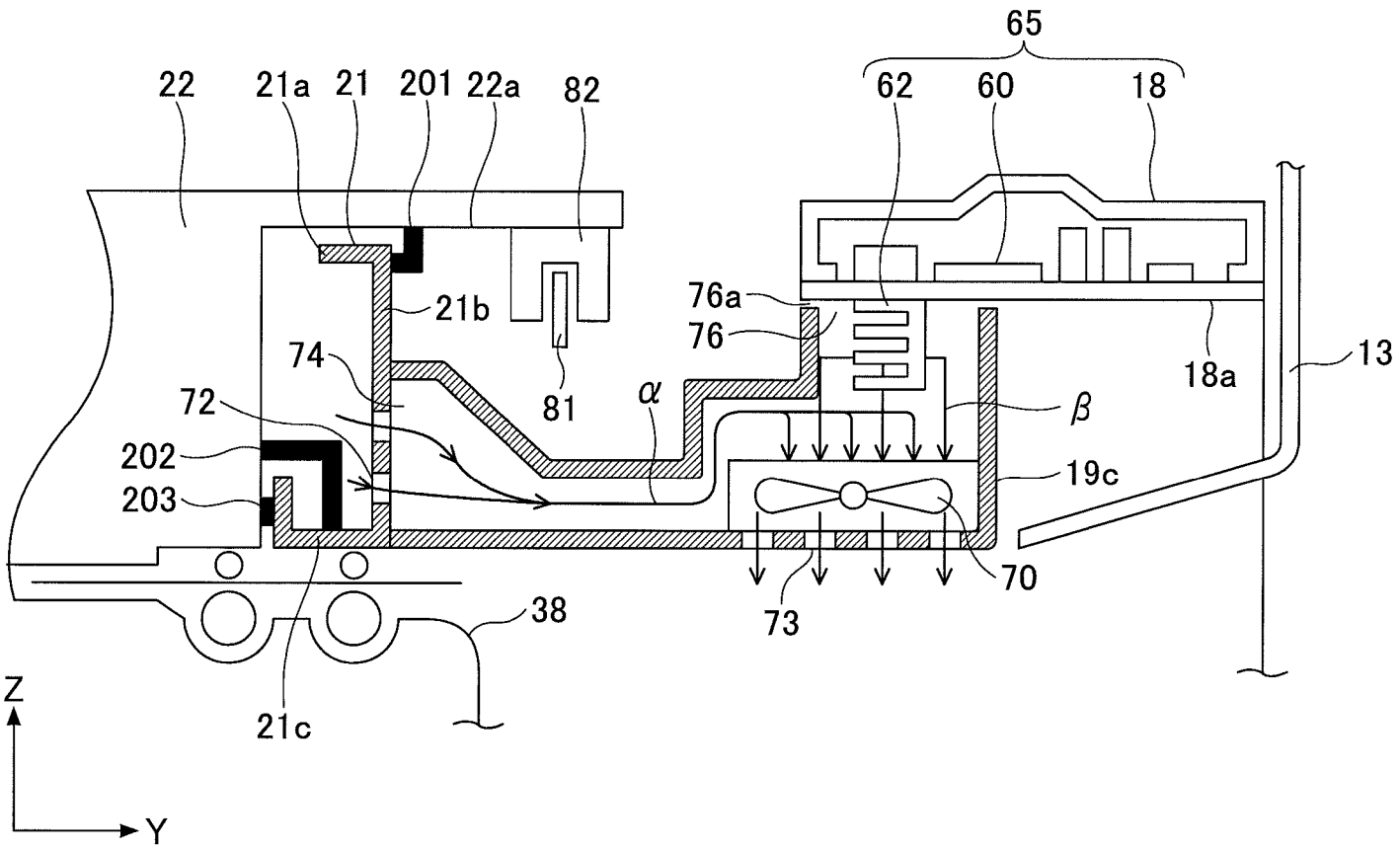
FIG. 9 shows a partial side sectional view of an image forming apparatus according to an embodiment 3.

FIG. 9 shows a partial side sectional view of the image forming apparatus according to the embodiment 3. As shown in FIG. 9, the second inflow opening parts 72 are provided in the rail 21, and the first inflow opening part 74 and the third inflow opening part 76 are provided in the rail supporting member 19*c*. As described above for the embodiment 1, the first inflow opening part 74 and the second inflow opening parts 72 are connected. Further, the air stream creation part 70 creates the air stream α having a flow of air along the second inflow opening parts 72→the first inflow opening part 74→the cavity part 75→the discharge opening parts 73 (the same as that described above for the embodiment 1) and also the air stream β having a flow of air along the space 76*a*→the third inflow opening part 76→the discharge opening part 73 (the same as that described above for the embodiment 2).

By the configuration of the embodiment 3, it is possible to discharge both the sub-liquid droplets produced from the image forming process and/or the dummy discharge process and the heat radiated from the radiation member 65.

It is noted that in the configuration of FIG. 9, the space 76*a* may be omitted. In a case where the space 76*a* is omitted, the heat radiated from the radiation member 65 can be discharged out from the discharge opening part 73 by heating a flow of air flowing in from the second inflow opening parts 72.

[Embodiment 4]

Next, an image forming apparatus according to an embodiment 4 of the present invention will be described. The image forming apparatus according to the embodiment 4 has a configuration similar to that of the image forming apparatus 1 according to the embodiment 1 described above. Below, description will be made in a manner of focusing on points different from the image forming apparatus according to the embodiment 1, and duplicate description will be omitted as is appropriate.

Generally speaking, in many cases, paper for which the printing process or image forming process has been finished is wet because of ink discharged by the recording heads 23 or curls because of having been thus wet (i.e., a phenomenon of the paper bending). The image forming apparatus according to the embodiment 4 avoids such wetting and/or curling of the paper 27.

Figure 10:
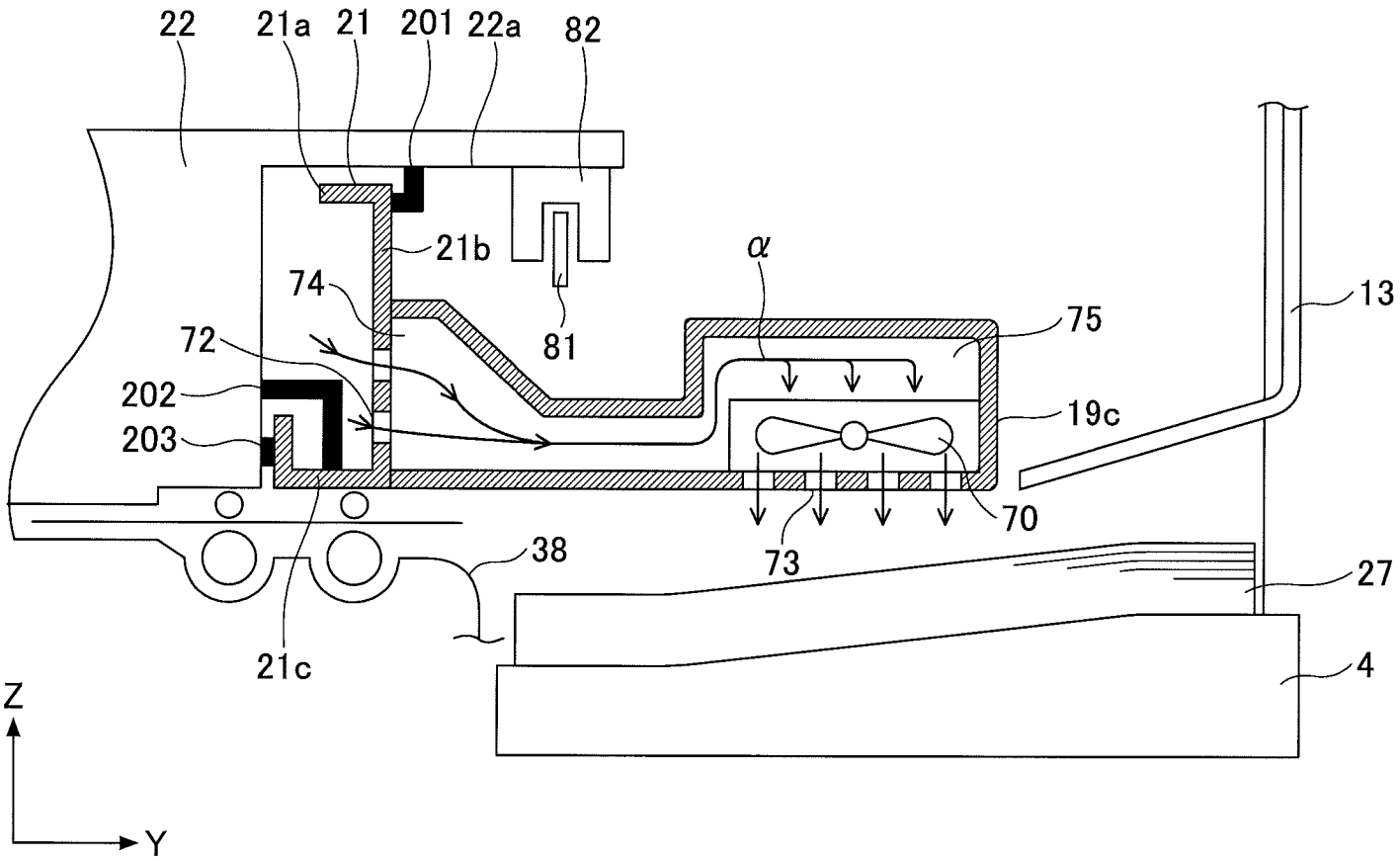
FIG. 10 shows a partial side sectional view of an image forming apparatus according to an embodiment 4.

FIG. 10 shows a partial side sectional view of the image forming apparatus according to the embodiment 4. According to the embodiment 4, the paper ejection tray 4 is disposed below the rail supporting member 19*c*. As mentioned above, the sheets of paper 27 for which the image forming processes have been finished are stacked on the paper ejection tray 4.

The paper ejection tray 4 is disposed at a position such that air (air stream α) including the sub-liquid droplets, created by the air stream creation part 70 and discharged from the discharge opening parts 73, is discharged toward the sheets of paper 27 stacked on the paper ejection tray 4, that is, a position such that the air stream α hits the paper 27. In other words, the discharge opening parts 73 are disposed to face the paper 27 stacked on the paper ejection tray 4.

Thus, the air (air stream α) discharged from the discharge opening parts 73 hits the paper 27 stacked on the paper ejection tray 4, and thereby, drying of the paper 27 can be accelerated. Thus, the image forming apparatus according to the embodiment 4 has an advantageous effect of avoiding wetting and/or curling of the paper 27 for which the image forming processes have been finished.

[Embodiment 5]

Next, an image forming apparatus according to an embodiment 5 of the present invention will be described. The image forming apparatus according to the embodiment 5 has a configuration similar to that of the image forming apparatus 1 according to the embodiment 1 described above. Below, description will be made in a manner of focusing on points different from the image forming apparatus according to the embodiment 1, and duplicate description will be omitted as is appropriate.

Figure 11:
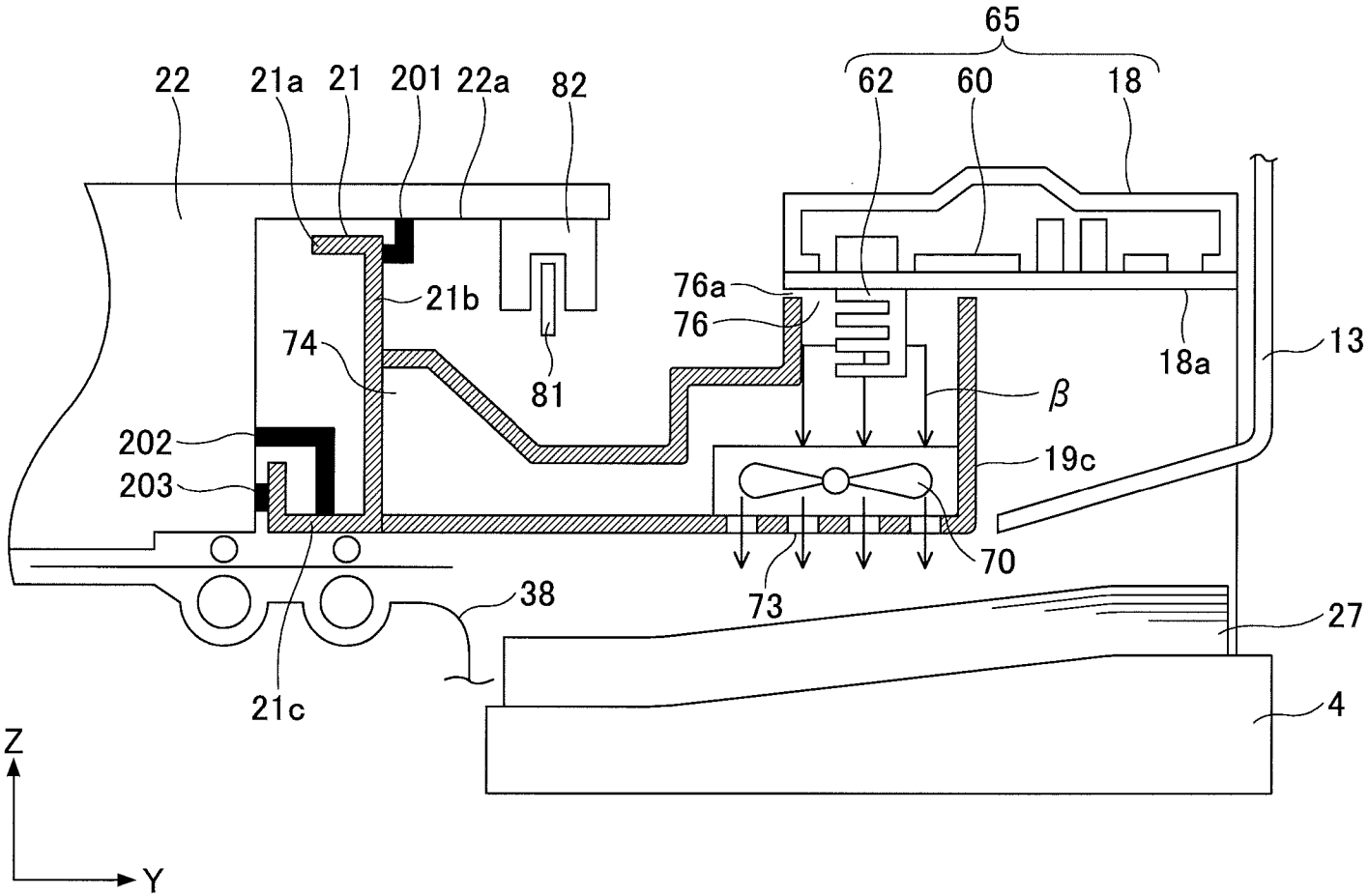
FIG. 11 shows a partial side sectional view of an image forming apparatus according to an embodiment 5.

The same as the image forming apparatus according to the embodiment 4 described above, the image forming apparatus according to the embodiment 5 avoids wetting and/or curling of the paper 27 for which the image forming processes have been finished. FIG. 11 shows a partial side sectional view of the image forming apparatus according to the embodiment 5. In comparison to FIG. 8, the image forming apparatus according to the embodiment 5 of FIG. 11 is different in that the paper ejection tray 4 is disposed below the rail supporting member 19*c*. In the image forming apparatus according to the embodiment 5, the heat from the radiation member 65 (as described above for the embodiment 2) is transferred to the paper 27 on the paper ejection tray 4. As described above for the embodiment 4, heated air discharged from the discharge opening parts 73 is discharged against the paper stacked on the paper ejection tray 4.

In the embodiment 5, the air (air stream β) including the heat radiated from the radiation member 65, discharged from the discharge opening parts 73, is caused to hit the paper 27 stacked on the paper ejection tray 4. Thus, drying of the paper 27 is accelerated. Thus, in comparison to the embodiment 4 in which the air including the sub-liquid droplets is caused to hit the paper 27, the heated air is caused to hit the paper in the embodiment 5. Therefore, it is possible to avoid the wetting and/or curling of the paper 27 for which the image forming processes have been finished, more effectively, in comparison to the image forming apparatus according to the embodiment 4.

[Embodiment 6]

Next, an image forming apparatus according to an embodiment 6 of the present invention will be described. The image forming apparatus according to the embodiment 6 has a configuration similar to that of the image forming apparatus 1 according to the embodiment 1 described above. Below, description will be made in a manner of focusing on points different from the image forming apparatus according to the embodiment 1, and duplicate description will be omitted as is appropriate.

Figure 12:
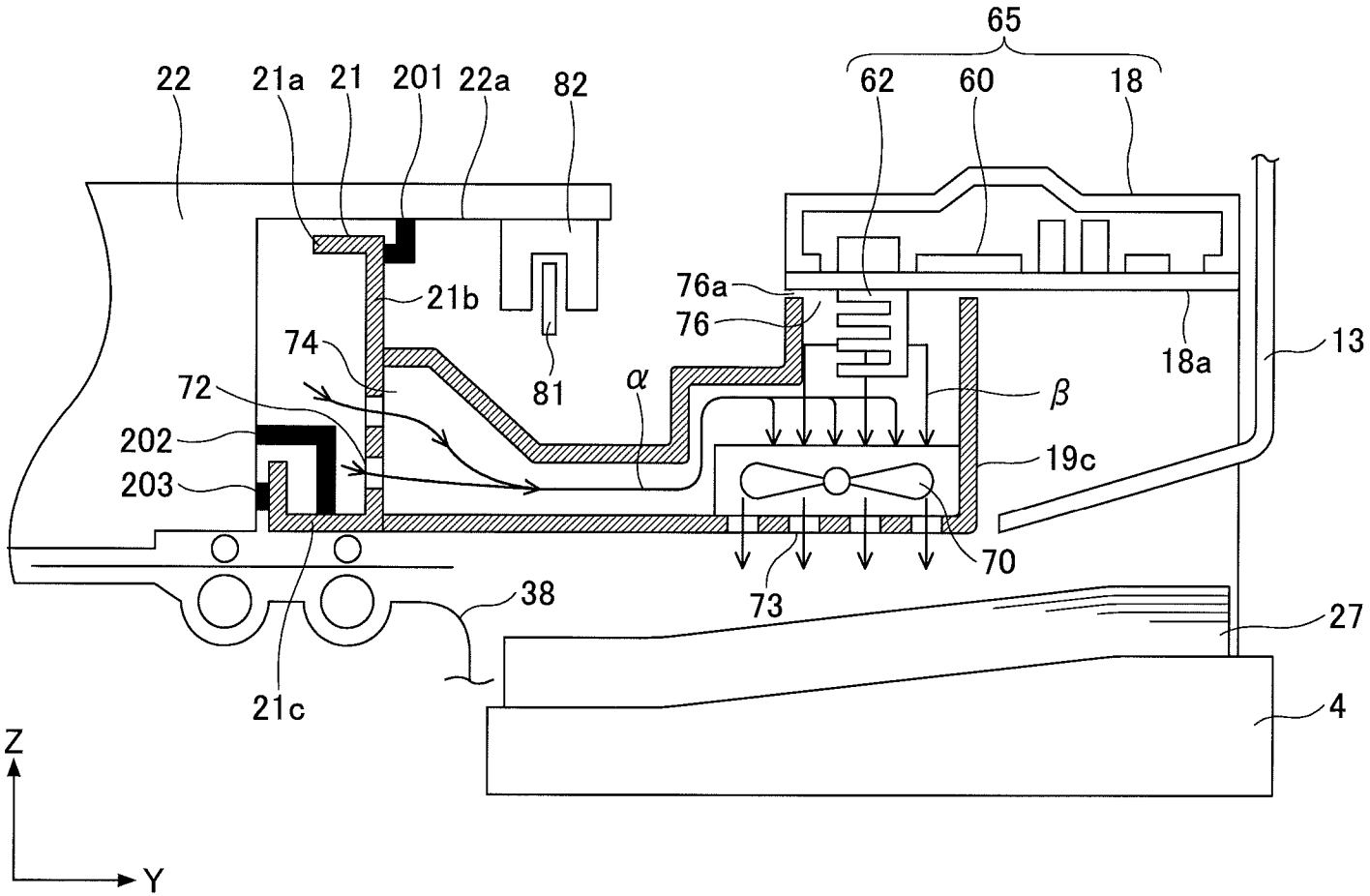
FIG. 12 shows a partial side sectional view of an image forming apparatus according to an embodiment 6.

The same as the respective image forming apparatuses according to the embodiment 4 and the embodiment 5 described above, the image forming apparatus according to the embodiment 6 avoids wetting and/or curling of the paper 27 for which the image forming processes have been finished. FIG. 12 shows a partial side sectional view of the image forming apparatus according to the embodiment 6. In comparison to the FIG. 9, the image forming apparatus according to the embodiment 6 of FIG. 12 is different in that the paper ejection tray 4 is disposed below the rail supporting member 19*c*.

The image forming apparatus according to the embodiment 6 has a feature of a combination of the respective features of the configuration (described above for the embodiment 1) of discharging the sub-liquid droplets produced from the image forming process or the dummy discharge process, and the configuration (described above for the embodiment 2) of transferring the heat radiated from the radiation member. In the image forming apparatus according to the embodiment 6, the heat from the radiation member 65 (as described above for the embodiment 2) is transferred to the paper 27 on the paper ejection tray 4. As described above for the embodiment 4, heated air discharged from the discharge opening parts 73 is discharged against the paper stacked on the paper ejection tray 4.

In the embodiment 6, the air (air stream β) including the heat radiated from the radiation member 65, discharged from the discharge opening parts 73, is caused to hit the paper 27 stacked on the paper ejection tray 4. Thus, drying of the paper 27 is accelerated. In the embodiment 4, the air including the sub-liquid droplets is caused to hit the paper 27. In the embodiment 6, the air including the heat, in addition to the air including the sub-liquid droplets, is further caused to hit the paper. Therefore, it is possible to avoid wetting and/or curling of the paper 27 for which the image forming processes have been finished, more effectively, in comparison to the image forming apparatus according to the embodiment 4.

It is noted that also in the configuration of FIG. 12, the space 76*a* may be omitted. In a case where the space 76*a* is omitted, the heat radiated from the radiation member 65 can be transferred out from the discharge opening part 73 by heating the flow of air flowing in from the second inflow opening parts 72.

[Embodiment 7]

Next, an image forming apparatus according to an embodiment 7 of the present invention will be described. The image forming apparatus according to the embodiment 7 has a configuration similar to that of the image forming apparatus 1 according to the embodiment 1 described above. Below, description will be made in a manner of focusing on points different from the image forming apparatus according to the embodiment 1, and duplicate description will be omitted as is appropriate.

As described above, the sub-liquid droplets are ink mist or such. In the image forming apparatus according to the embodiment 7, the ink mist or such is further efficiently collected. Further, below, the upstream side of the air stream α will be simply referred to as "the upstream side" and the downstream side of the air stream α will be simply referred to as "the downstream side".

Figure 13A:
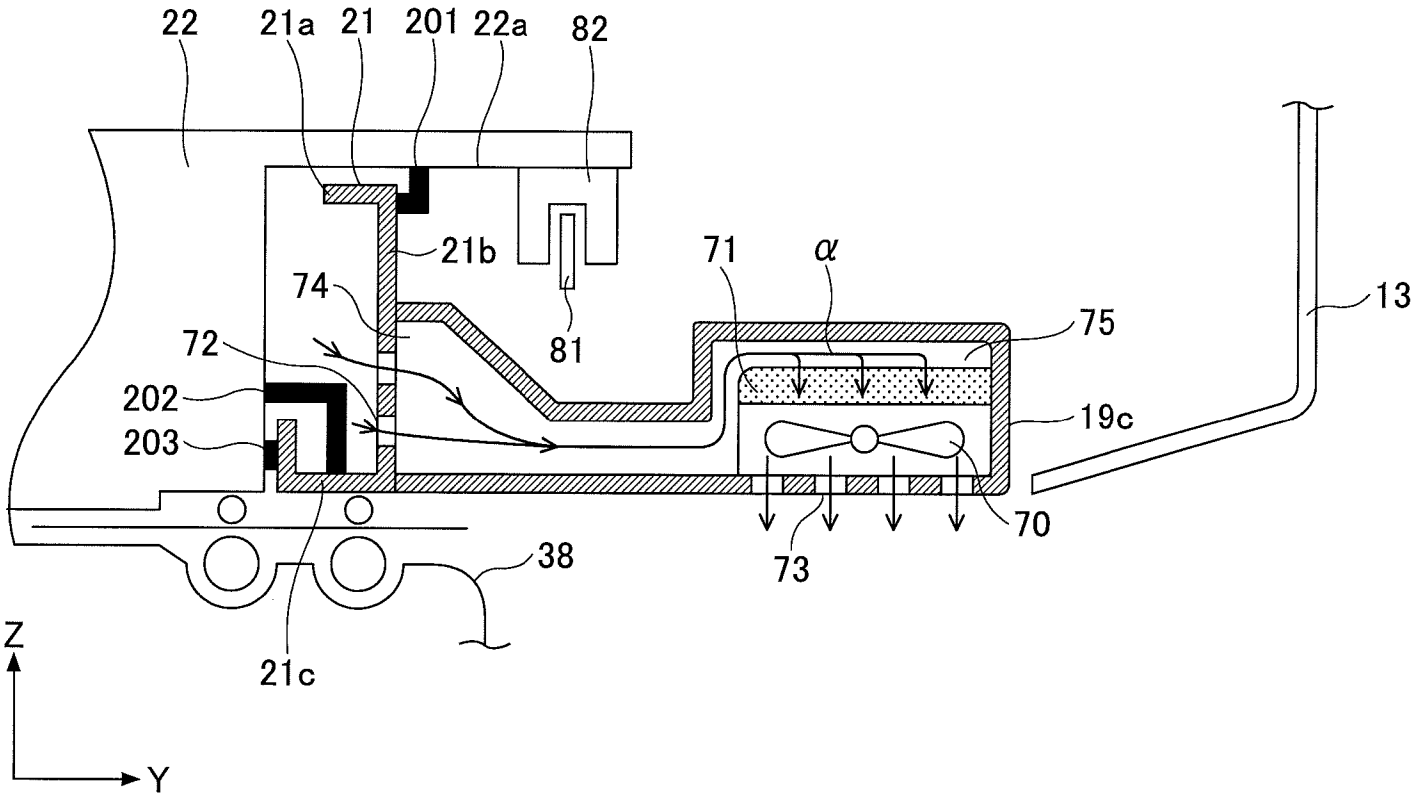
FIG. 13A shows a partial side sectional view of an image forming apparatus according to an embodiment 7.

FIG. 13A shows a partial side sectional view of the image forming apparatus according to the embodiment 7. The image forming apparatus of FIG. 13A is different from the image forming apparatus of FIG. 7 in that a filter 71 is disposed on the upstream side of the air stream creation part 70. The filter 71 can collect (i.e., filter out) the sub-liquid droplets, for example, ink mist or such, conveyed by the air stream α. Further, the filter 71 is detachable by the user.

Figure 13B:
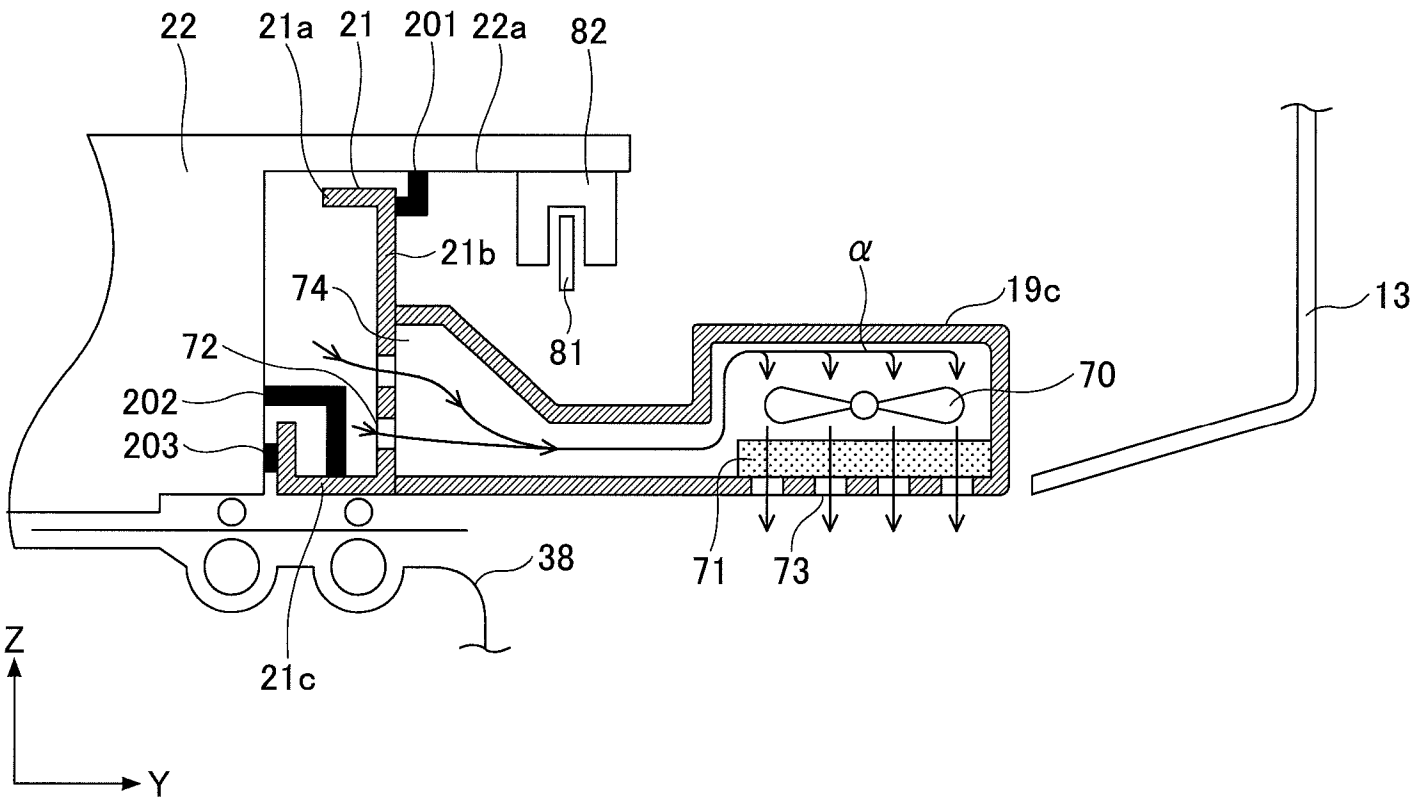
FIG. 13B shows a partial side sectional view of an image forming apparatus according to a variant embodiment of the embodiment 7.

Further, in the example of FIG. 13A, the filter 71 is disposed on the upstream side of the air stream creation part 70 as mentioned above. However, the filter 71 may be disposed on the downstream side of the air stream creation part 70. FIG. 13B shows a variant embodiment of the embodiment 7 in which the filter 71 is disposed on the downstream side of the air stream creation part 70. Advantageous effects of the respective cases will be described now.

When the filter 71 is disposed on the upstream side of the air stream creation part 70 as in the embodiment 7 of FIG. 13A, it is possible to reduce pressure loss, and it is possible to create the more stable air stream α. When the filter 71 is disposed on the downstream side of the air stream creation part 70 as in the variant embodiment of the embodiment 7 of FIG. 13B, the user can easily remove the filter 71, and thus easily carry out the work of replacing the filter 71.

By thus providing the filter 71 as in the embodiment 7 or the variant embodiment thereof, it is possible to effectively collect the sub-liquid droplets such as ink mist.

Further, also in each of the respective image forming apparatuses described above with reference to FIGS. 8 through 12, the filter 71 may be provided.

[Embodiment 8]

Next, an image forming apparatus according to an embodiment 8 will be described.

Below, a reference numeral of the carriage in the embodiment 8 is 122 for the purpose of distinguishing the carriage 122 in the embodiment 8 from the carriage 22 in the embodiment 1. Similarly, a reference numeral of the rail supporting member in the embodiment 8 is 119*c* for the purpose of distinguishing the rail supporting member 119*c* in the embodiment 8 from the rail supporting member 19*c* in the embodiment 1.

The carriage 122 in the image forming apparatus according to the embodiment 8 has the same configuration and the same function as those of the carriage 22 in the image forming apparatus 1 according to the embodiment 1 described above except for the points described below with reference to FIG. 14. Therefore, for the carriage 122, a duplicate of the description made for the carriage 22 of the embodiment 1 will be omitted as is appropriate. Similarly, the rail supporting member 119*c* in the image forming apparatus according to the embodiment 8 has the same configuration and the same function as those of the rail supporting member 19*c* in the image forming apparatus 1 according to the embodiment 1 described above except for the points described below with reference to FIG. 14. Therefore, for the rail supporting member 119*c*, a duplicate of the description made for the rail supporting member 19*c* of the embodiment 1 will be omitted as is appropriate.

Next, a mechanism of collecting the sub-liquid droplets in the image forming apparatus according to the embodiment 8 will be described. In the mechanism of collecting the sub-liquid droplets in the image forming apparatus according to the embodiment 8, an air stream creation part 170 is provided to face a first inflow opening part 87 as will be described later with reference to FIG. 14, in comparison to the mechanism of collecting the sub-liquid droplets in the image forming apparatus according to the embodiment 1 described above with reference to FIG. 7 in which the air stream creation part 70 is provided to face the discharge opening part 73. Further, according to the embodiment 1, as shown in FIG. 7, the air stream α created by the air stream creation part 70 flows in from the first inflow opening part 74 and flows out from the discharge opening part 73. In contrast thereto, according to the embodiment 8 of FIG. 14, the air stream created by the air stream creation part 170 flows in from the first inflow opening part 87 and flows out from a discharge opening part 85. Further, in the embodiment 8, the position detection part (81 and 82) is provided in a flow path extending from the first inflow opening part 87 to the discharge opening part 85. FIG. 14 shows a partial side sectional view of the mechanism of collecting the sub-liquid droplets in the image forming apparatus according to the embodiment 8.

Figure 14:
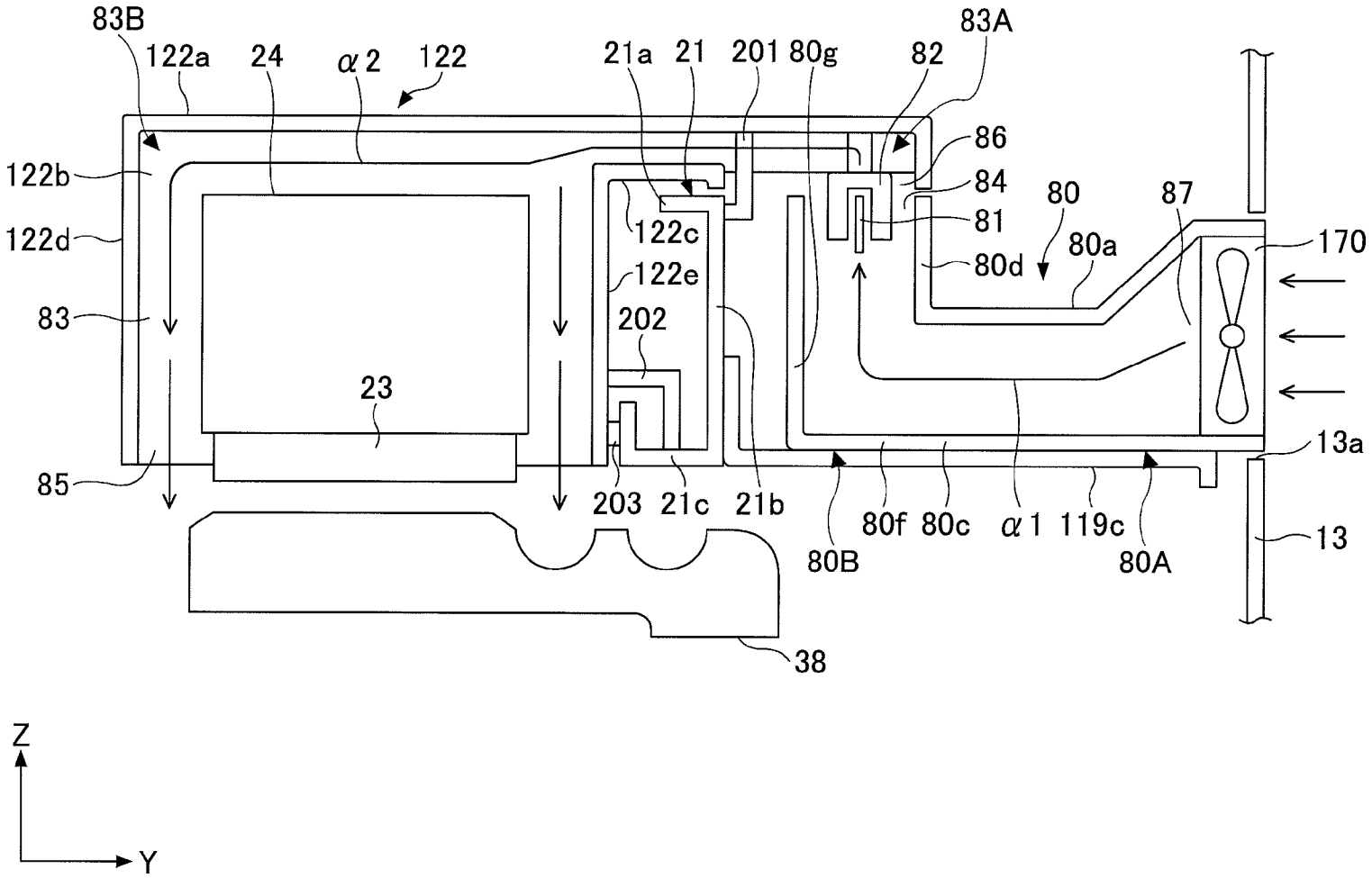
FIG. 14 shows a partial side sectional view of an image forming apparatus according to an embodiment 8.

As shown in FIG. 14, the air stream creation part 170 is provided in the image forming apparatus according to the embodiment 8. The air stream creation part 170 creates the air stream under the control of the control part 206 (see FIG. 1). The air stream creation part 170 includes, for example, a fan. In the case where the air stream creation part 170 is a fan, an impeller of the fan is rotated by a motor (not shown), and thereby the air stream is created.

As shown in FIG. 14, the air stream creation part 170 is provided in such a manner to take in the external air from an opening part 13*a* that is an opening provided in the cover 13 that covers the outside of the image forming apparatus, and takes in the air from the outside of the image forming apparatus into the inside of the image forming apparatus.

Further, the linear encoder 81, which is the extending part of the position detection part that detects the position of the carriage 122 in the main scan directions, is provided on the back side (i.e., the right side in FIG. 14) of the rail 21. The encoder sensor 82, which is the detection part of the position detection part, is provided in the carriage 122. Thus, the linear encoder 81 and the encoder sensor 82 are included in the position detection part.

The linear encoder 81 is attached to, for example, extending flow path part side plates of a first air flow path 80 (described later), and the encoder sensor 82 is attached to, for example, a top plate 122*a* of the carriage 122 (see FIG. 14).

The linear encoder 81 has a linear shape, and the scale information is provided on the surface of the linear encoder 81. As the carriage 122 moves in the main scan directions, the encoder sensor 82, which moves along with the carriage 122 along the linear encoder 81, optically or magnetically reads the scale information of the linear encoder 81. Thus, the encoder sensor 82 detects the position of the carriage 122 in the main scan directions. The information of the detected position of the carriage 122 is sent to the control part 206, and the control part 206 then uses the information in control of forming an image on the paper 27 (i.e., the image forming process).

On the back side of the rail 21, the first air flow path 80 that is hollow is provided. The first inflow opening part 87 that is an inflow opening for the first air flow path 80 is connected to the air stream creation part 170, and air is introduced from the outside of the image forming apparatus into the first air flow path 80 by means of the air stream creation part 170. Further, a discharge opening part 84 that is a discharge opening of the first air flow path 80 is provided in such a manner to cover the linear encoder 81 and the encoder sensor 82.

The first air flow path 80 has an introduction part 80A that is connected to the air stream creation part 170, and the introduction part 80A includes an introduction part top plate 80*a* that is a top plate of the introduction part 80A; two introduction part side plates that are left and right side plates of the introduction part 80A, respectively; and an introduction part bottom plate 80*c* that is a bottom plate of the introduction part 80A. The introduction part 80A of the first air flow path 80 may have an approximately tube shape with the introduction part top plate 80*a*, the introduction part side plates and the introduction part bottom plate 80*c*, and introduces the air stream created by the air stream creation part 170 into an extending flow path part 80B (described later) of the first air flow path 80.

The first air flow path 80 further includes the extending flow path part 80B that includes an extending flow path part fixing plate 80*d* standing on the side nearer the air stream creation part 170; the two extending flow path part side plates that are left and right side plates of the extending flow path part 80B; an extending flow path part standing plate 80*g* standing opposite to the extending flow path part fixing plate 80*d*; and an extending flow path part bottom plate 80*f* that is a bottom plate of the extending flow path part 80B. The extending flow path part 80B of the first air flow path 80 may have a shape like a container with the extending flow path part fixing plate 80*d*, the two extending flow path part side plates, the extending flow path part standing plate 80*g* and the extending flow path part bottom plate 80*f*. The extending flow path part 80B of the first air flow path 80 has the discharge opening part 84 that is an opening formed on the top of the extending flow path part 80B, and the extending flow path part 80B of the first air flow path 80 extends in the X-axis directions along the linear encoder 81. Further, the above-mentioned introduction part 80A of the first air flow path 80 is attached (connected) to the extending flow path part fixing plate 80*d* of the extending flow path part 80B, and thus, the extending flow path part 80B communicates with the introduction part 80A in the first air flow path 80 as shown in FIG. 14. The first air flow path 80 including the introduction part 80A and the extending flow path part 80B is attached to the rail supporting member 119*c*. The extending flow path part 80B of the first air flow path 80 receives the air which has been introduced from the outside through the introduction part 80A by means of the air stream creation part 170, introduces the air in the X-axis directions (i.e., the main scan directions), and also, introduces the air upward into a second air flow path 83.

The second air flow path 83 is provided in the carriage 122, and has an inflow opening part 86 that is an opening formed to face the discharge opening part 84 of the first air flow path 80. Further, the second air flow path 83 has the discharge opening part 85 that is a discharge opening of the second air flow path 83 and is formed to face the platen 38.

The carriage 122 has a top plate 122*a*; two side plates that are left and right side plates; a fixing plate 122*e* standing on the side nearer the first air flow path 80; a standing plate 122*d* standing opposite to the fixing plate 122*e*; and a bottom plate 122*c* opposite to the top plate 122*a* and existing only on the side nearer the first air flow path 80. The second air flow path 83 is formed (defined) by the top plate 122*a*, the left and right side plates, the fixing plate 122*e*, the standing plate 122*d* and the bottom plate 122*c* of the carriage 122, and the outer surfaces of the sub-tanks (head tanks) 24. A discharge part 83B of the second air flow path 83, having a shape like a container, is formed (defined) by a part (left in FIG. 14) of the top plate 122*a*, parts (left in FIG. 14) of the respective ones of the left and right side plates, the fixing plate 122*e* and the standing plate 122*d* of the carriage 122, and the outer surfaces of the sub-tanks 24. The discharge part 83B of the second air flow path 83 encloses the top surfaces and the side surfaces of the sub-tanks 24, and the discharge part 83B of the second air flow path 83 has the discharge opening part 85 that is the opening formed on the bottom side of the discharge part 83B. Further, the second air flow path 83 has an introduction part 83A on the (right in FIG. 14) side nearer the first air flow path 80. The introduction part 83A of the second air flow path 83 is formed (defined) by the other part (right in FIG. 14) of the top plate 122*a*, the other parts (right in FIG. 14) of the left and right side plates and the bottom plate 122*c* of the carriage 122. The introduction part 83A of the second air flow path 83 takes in, from the inflow opening part 86, the air discharged from the first air flow path 80, and introduces the taken air into the discharge part 83B of the second air flow path 83. Thus, the second air flow path 83 includes the introduction part 83A and the discharge part 83B.

The air stream α1 created by the air stream creation part 170 and introduced into the first air flow path 80 passes through the introduction part 80A and the extending flow path part 80B of the first air flow path 80, and then is introduced into the second flow path part 83 and becomes the air stream α2. Thus, after being introduced into the first inflow opening part 87 that is the inflow opening of the first air flow path 80 from the outside of the image forming apparatus, the air stream α1 passes through the first air flow path 80 and passes through the linear encoder 81 and the encoder sensor 82. Then, the air stream α1 is introduced into the inflow opening part 86 of the second air flow path 83 from the discharge opening part 84 of the first air flow path 80 and becomes the air stream α2. The air stream α2 thus introduced into the second air flow path 83 in the carriage 122 is introduced into the discharge part 83B from the introduction part 83A of the second air flow path 83. Then, the air stream α2 passes through the surrounding area of the sub-tanks 24, i.e., the discharge part 83B, and after that, is discharged from the discharge opening part 85 toward the platen 38. It is noted that the discharge opening part 85 is the opening formed at the surrounding area of the recording heads 23, and is the discharge opening of the second air flow path 83.

Thus, in the image forming apparatus according to the embodiment 8, the linear encoder 81 and the encoder sensor 82 are provided in the first air flow path 80, and the fresh air is introduced from the outside of the image forming apparatus into the linear encoder 81 and the encoder sensor 82. Thus, it is possible to avoid adhesion of the sub-liquid droplets produced from the inside of the image forming apparatus to the linear encoder 81 and the encoder sensor 82. Also, by means, of the air stream α2 flowing through the surrounding area of the sub-tanks 24 and the recording heads 23, it is possible to straighten the air flow near the nozzles of the recording heads 23, and avoid scattering of the sub-liquid droplets because of an air-curtain effect obtained from the straightened air flow near the nozzles of the recording heads 23.

Furthermore, the created air stream can prevent the recording heads 23 from being heated, and avoid the temperature rise of the recording liquid (i.e., the ink) otherwise occurring due to the temperature rise of the recording heads 23, and thus it is possible to effectively avoid degradation of a printed image otherwise occurring because of a failure of discharging ink droplets from the recording heads 23.

It is noted that in the embodiment 8, the first air flow path 80 and the rail supporting member 119*c* may act as the fixing part that fixes the rail 20 in the image forming apparatus.

[Embodiment 9]

Next, a mechanism of collecting the sub-liquid droplets in an image forming apparatus according to an embodiment 9 of the present invention will be described. The image forming apparatus according to the embodiment 9 has a configuration similar to that of the image forming apparatus according to the embodiment 8 described above. Below, description will be made in a manner of focusing on points different from the image forming apparatus according to the embodiment 8, and duplicate description will be omitted as is appropriate.

Figure 15:
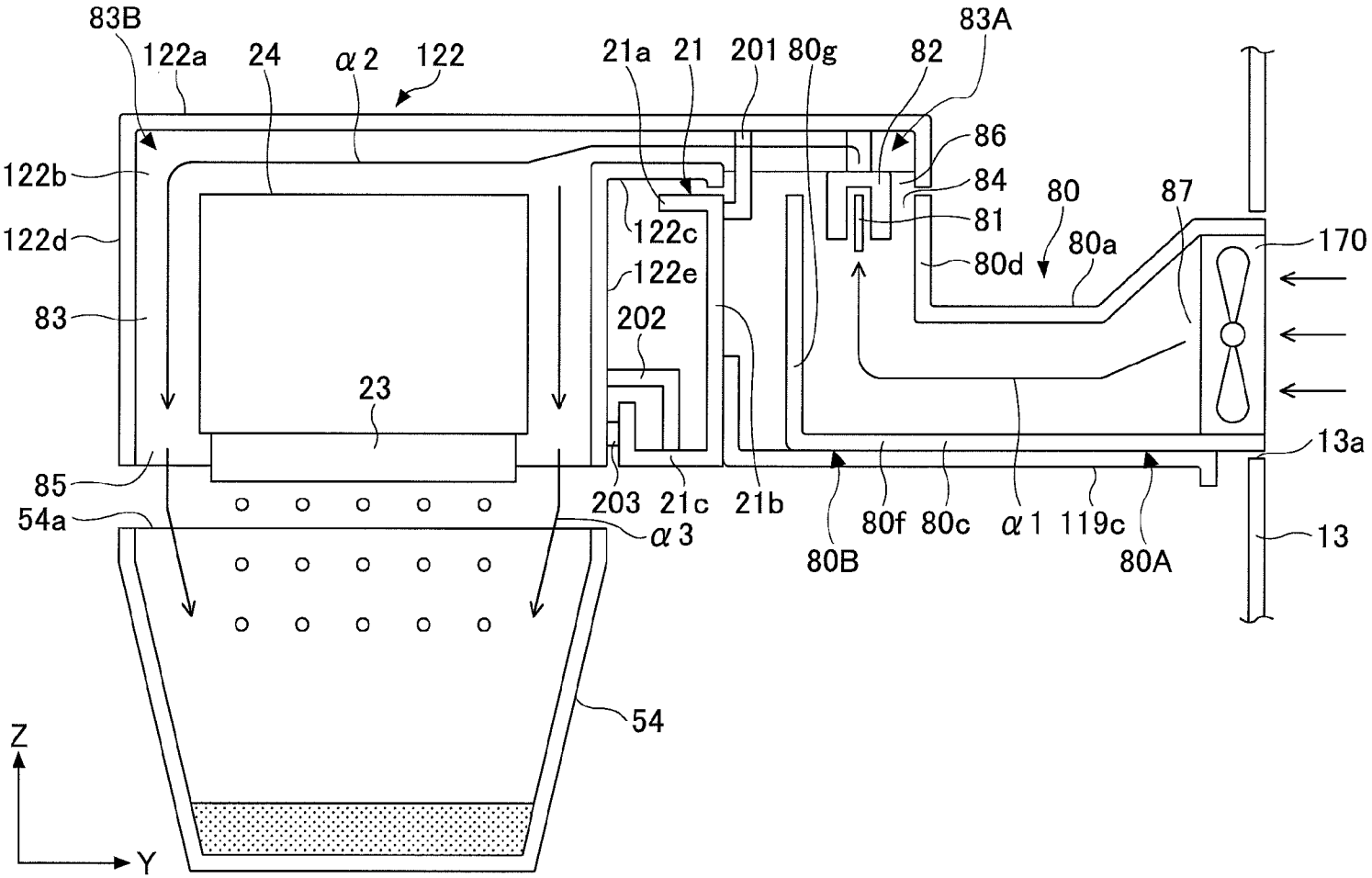
FIG. 15 shows a partial side sectional view of an image forming apparatus according to an embodiment 9.

FIG. 15 shows a partial side sectional view of the mechanism of collecting the sub-liquid droplets in the image forming apparatus according to the embodiment 9. The mechanism of collecting the sub-liquid droplets according to the embodiment 9 is approximately the same as the mechanism of collecting the sub-liquid droplets according to the embodiment 8 described above with reference to FIG. 14. The same reference numerals are given to the identical parts/components, and duplicate description will be omitted as is appropriate.

Figure 18:
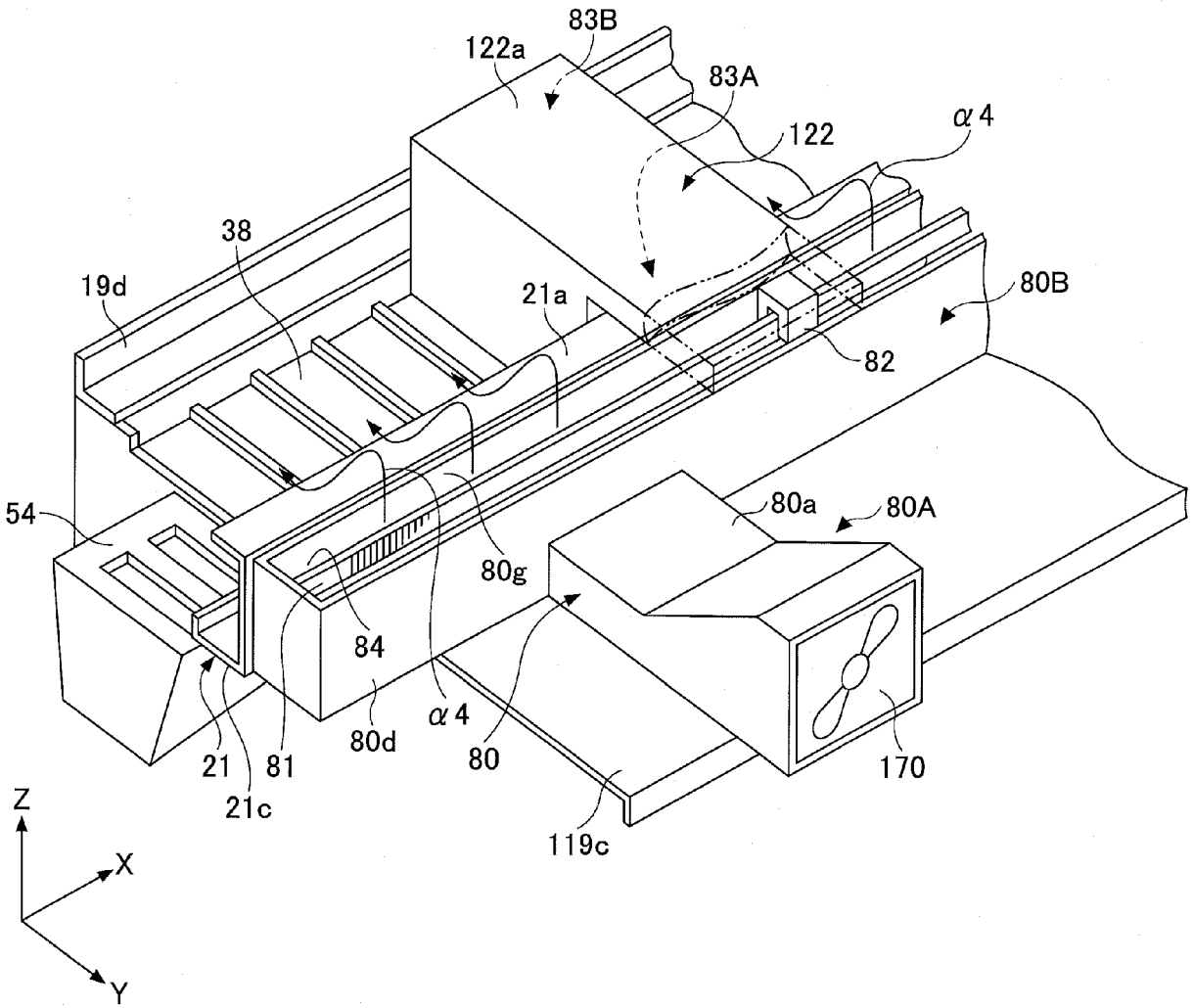
FIG. 18 shows a partial perspective view of an image forming apparatus according to an embodiment 13.

In the image forming apparatus according to the embodiment 9, a left dummy discharge receiver 54 is provided in a non-printing zone as shown in FIG. 18 that shows a partial perspective view of an image forming apparatus according to an embodiment 13 of the present invention described later. As shown in FIG. 15, an introduction opening part 54*a* that is an opening of the left dummy discharge receiver 54 is formed in such a manner to face the discharge opening part 85, which is the discharge opening of the second air flow path 83 provided in the carriage 122, when the carriage 122 is moved along the rail 21 to above the left dummy discharge receiver 54 and a dummy discharge process is carried out.

That is, according to the embodiment 9, the air stream creation part 170 creates air streams α1, α2 and α3 passing through an air path along the outside of the image forming apparatus→the first air flow path 80→the second air flow path 83→the left dummy discharge receiver 54, when the carriage 122 is moved to the left dummy discharge receiver 54 and the dummy discharge process is carried out. In this case, as shown in FIG. 15, the air stream α3 that is straightened by the second air flow path 83 is introduced into the left dummy discharge receiver 54. Thus, it is possible to avoid scattering of the sub-liquid droplets to the other parts in the image forming apparatus, and also to efficiently collect the sub-liquid droplets into the left dummy discharge receiver 54.

Further, when an introduction opening part of the dummy discharge receiver 53 (see FIG. 4) is provided in the maintenance and recovery mechanism 50 having the same configuration as that of the introduction opening part 54*a* of the left dummy discharge receiver 54, a further advantageous effect can be obtained. That is, the introduction opening part of the dummy discharge receiver 53 that is an opening of the dummy discharge receiver 53 is formed in such a manner to face the discharge opening part 85 of the second air flow path 83 provided in the carriage 122, when the carriage 122 is moved along the rail 21 to the recovery zone B (see FIG. 4) and the dummy discharge process is carried out in the maintenance and recovery process carried out by the maintenance and recovery mechanism 50. As a result, it is possible to avoid scattering of the sub-liquid droplets produced from the dummy discharge process to the other parts in the image forming apparatus, and also to efficiently collect the produced sub-liquid droplets into the dummy discharge receiver 53.

[Embodiment 10]

Next, a mechanism of collecting the sub-liquid droplets in an image forming apparatus according to an embodiment 10 of the present invention will be described. The image forming apparatus according to the embodiment 10 has a configuration similar to that of the image forming apparatus according to the embodiment 8 described above. Below, description will be made in a manner of focusing on points different from the image forming apparatus according to the embodiment 8, and duplicate description will be omitted as is appropriate.

Figure 16:
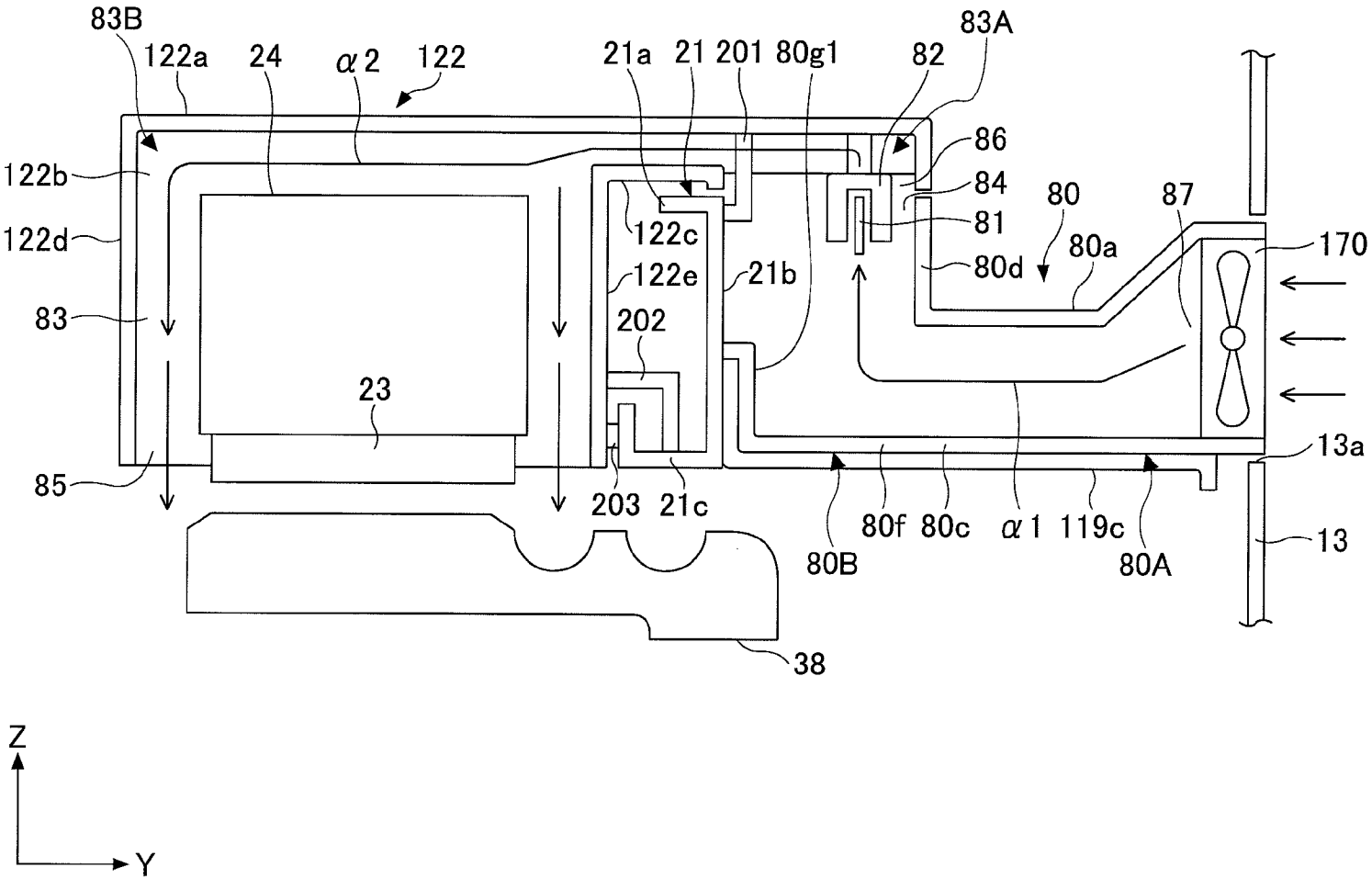
FIG. 16 shows a partial side sectional view of an image forming apparatus according to an embodiment 10.

FIG. 16 shows a partial side sectional view of the mechanism of collecting the sub-liquid droplets in the image forming apparatus according to the embodiment 10. The mechanism of collecting the sub-liquid droplets according to the embodiment 10 is approximately the same as the mechanism of collecting the sub-liquid droplets according to the embodiment 8 described above with reference to FIG. 14. The same reference numerals are given to the identical parts/components, and duplicate description will be omitted as is appropriate.

According to the embodiment 10, a part of the configuration of the first air flow path 80 is provided by a part of the rail 21 that guides the carriage 122 in the main scan directions. Thus, it is possible to reduce the size of the first air flow path 80, and thus it is possible to miniaturize and reduce the costs of the image forming apparatus.

That is, as shown in FIG. 16, an extending flow path part standing plate lower part 80*g*1 is provided, instead of the extending flow path part standing plate 80*g* of the extending flow path part 80B of the first flow path 80 in the embodiment 8 of FIG. 14. The height of the extending flow path part standing plate lower part 80*g*1 is less than the height of the extending flow path part standing plate 80*g* of the embodiment 8, and a top end part of the extending flow path part standing plate lower part 80*g*1 is connected to the fixing plate 21*b* of the rail 21, as shown in FIG. 16. As a result, a similar configuration to that of the extending flow path part standing plate 80*g* of the first air flow path 80 of the embodiment 8 of FIG. 14 is obtained from the extending flow path part standing plate lower part 80*g*1 and the upper part of the fixing plate 21*b* of the rail 21, i.e., a vertical wall surface of the extending flow path part 80B parallel to both the X-axis direction and the Z-axis direction is obtained.

[Embodiment 11]

Next, a mechanism of collecting the sub-liquid droplets in an image forming apparatus according to an embodiment 11 of the present invention will be described. The image forming apparatus according to the embodiment 11 has a configuration similar to that of the image forming apparatus according to the embodiment 8 described above. Below, description will be made in a manner of focusing on points different from the image forming apparatus according to the embodiment 8, and duplicate description will be omitted as is appropriate.

Figure 17:
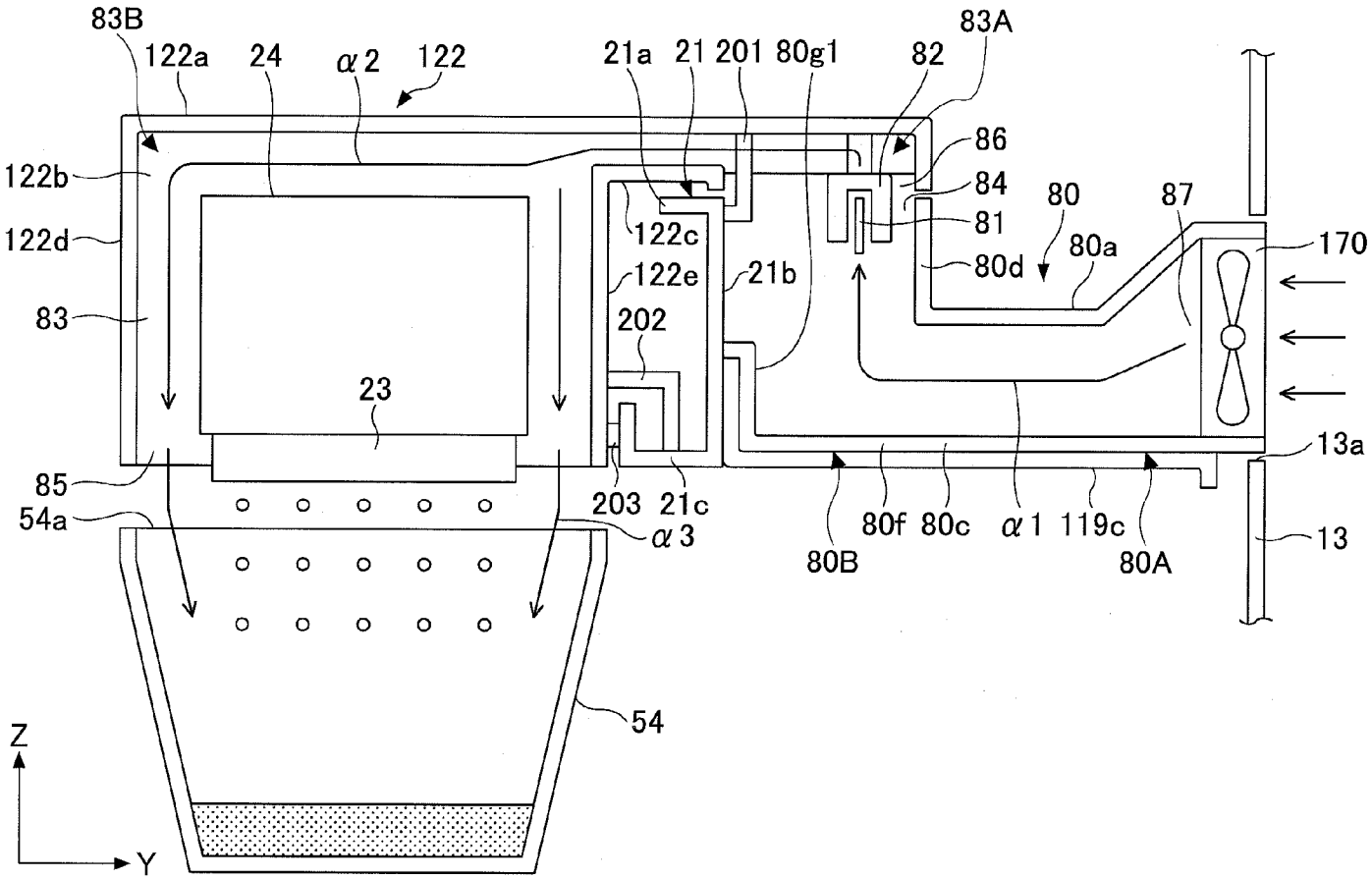
FIG. 17 shows a partial side sectional view of an image forming apparatus according to an embodiment 11.

FIG. 17 shows a partial side sectional view of the mechanism of collecting the sub-liquid droplets in the image forming apparatus according to the embodiment 11. The mechanism of collecting the sub-liquid droplets according to the embodiment 11 is approximately the same as the mechanism of collecting the sub-liquid droplets according to the embodiment 9 described above with reference to FIG. 15. The same reference numerals are given to the identical parts/components, and duplicate description will be omitted as is appropriate.

According to the embodiment 11, the same as the embodiment 10 of FIG. 16 described above, a part of the configuration of the first air flow path 80 is provided by a part of the rail 21 that guides the carriage 122 in the main scan directions. Thus, it is possible to reduce the size of the first air flow path 80, and thus it is possible to miniaturize and reduce the costs of the image forming apparatus.

That is, as shown in FIG. 17, an extending flow path part standing plate lower part 80*g*1 is provided, instead of the extending flow path part standing plate 80*g* of the extending flow path part 80B of the first flow path 80 in the embodiment 9 of FIG. 15. The height of the extending flow path part standing plate lower part 80*g*1 is less than the height of the extending flow path part standing plate 80*g* of the embodiment 9, and a top end part of the extending flow path part standing plate lower part 80*g*1 is connected to the fixing plate 21*b* of the rail 21, as shown in FIG. 17. As a result, a similar configuration to that of the extending flow path part standing plate 80*g* of the first air flow path 80 of the embodiment 9 of FIG. 15 is obtained from the extending flow path part standing plate lower part 80*g*1 and the upper part of the fixing plate 21*b* of the rail 21, i.e., a vertical wall surface of the extending flow path part 80B parallel to both the X-axis direction and the Z-axis direction is obtained.

[Embodiment 12]

Next, a mechanism of collecting the sub-liquid droplets in an image forming apparatus according to an embodiment 12 of the present invention will be described. In the image forming apparatus according to the embodiment 12, in any one of the image forming apparatuses according to the embodiments 8, 9, 10 and 11, at least one of the left dummy discharge receiver 54 and the dummy discharge receiver 53 has such a configuration of being replaceable. As a result, at least one of the left dummy discharge receiver 54 and the dummy discharge receiver 53 does not need to have such a capacity of collecting the total amount of sub-liquid droplets that may be discharged throughout the life time of the image forming apparatus, and needs to have such a capacity of collecting the sub-liquid droplets that may be discharged for a predetermined replacement period of time. Thus, it is possible to miniaturize and reduce the costs of the image forming apparatus.

[Embodiment 13]

Next, a mechanism of collecting the sub-liquid droplets in an image forming apparatus according to an embodiment 13 of the present invention will be described. The image forming apparatus according to the embodiment 13 may have a configuration similar to that of any one of the image forming apparatuses according to the embodiments 8, 9, 10, 11 and 12 described above. Below, description will be made in a manner of focusing on points different from any one of the image forming apparatuses according to the embodiments 8, 9, 10, 11 and 12, and duplicate description will be omitted as is appropriate.

In any one of the image forming apparatuses according to the embodiments 8, 9, 10, 11 and 12 described above, the second air flow path 83 is provided in the carriage 122. In contrast thereto, according to the embodiment 13, the second air flow path 83 is not provided in the carriage 122. Below, description will be made in a manner of focusing on points different from any one of the image forming apparatuses according to the embodiments 8, 9, 10, 11 and 12, and duplicate description will be omitted as is appropriate.

FIG. 18 shows a partial perspective view of the mechanism of collecting the sub-liquid droplets in the image forming apparatus according to the embodiment 13. It is noted that in FIG. 18, a part of the carriage 122 on the side in the Y-axis direction, indicated by alternate long and two short dashed lines, is shown in a transparent manner for the sake of clearly showing a part of the linear encoder 81 and the encoder sensor 82 otherwise being hidden by the part of the carriage 122. In the embodiment 13, the air stream α1 created by the air stream creation part 170 and introduced into the first air flow path 80, passes through the introduction part 80A and the extending flow path part 80B of the first air flow path 80, is then discharged from the discharge opening part 84 of the first air flow path 80, and thus becomes an air stream α4. The discharge opening part 84 of the first air flow path 80 faces a top part of the cover 13 of the image forming apparatus (not shown in FIG. 18, see FIG. 5), and therefore, the air stream α4 is directed by the top part of the cover 13 and thus is discharged toward the platen 38, as shown in FIG. 18.

Thus, in the image forming apparatus according to the embodiment 13, the linear encoder 81 and the encoder sensor 82 are provided in the first air flow path 80, and the fresh air is introduced from the outside of the image forming apparatus into the linear encoder 81 and the encoder sensor 82. Thus, it is possible to avoid adhesion of the sub-liquid droplets produced from the inside of the image forming apparatus to the linear encoder 81 and the encoder sensor 82. Also, by means of the above-mentioned air stream α4, it is possible to straighten the air flows near the nozzles of the recording heads 23, and avoid scattering of the sub-liquid droplets because of the air-curtain effect provided by the straightened air flows.

The present invention is not limited to the specifically disclosed embodiments, and variations and modifications may be made without departing from the scope of the present invention.

The present application is based on Japanese Priority Applications Nos. 2010-141967 and 2011-036884, filed on Jun. 22, 2010 and Feb. 23, 2011, the entire contents of which are hereby incorporated herein by reference.

What is claimed is:

1. An image forming apparatus comprising:

a carriage including a recording head that discharges liquid droplets for forming an image onto a recording medium;

a rail that supports the carriage in such a manner that the carriage reciprocates;

a fixing part that fixes the rail in the image forming apparatus; and an air stream creation part that creates an air stream inside the fixing part, wherein the fixing part is hollow, and has a first inflow opening part and a discharge opening part, the fixing part is disposed on a first side of the rail and the carriage is disposed on another side of the rail that is opposite to the first side on which the fixing part is disposed, and the air stream is created inside the fixing part by the air stream creation part by drawing air from external to the fixing part to flow through the first inflow opening part to inside of the fixing part and causes the air inside of the fixing part to flow through the discharge opening part to outside of the fixing part.

2. The image forming apparatus as claimed in claim 1, wherein the rail has a second inflow opening part, the first inflow opening part and the second inflow opening part are connected, and the air stream created by the air stream creation part causes air to flow in from the second inflow opening part.

3. The image forming apparatus as claimed in claim 2, wherein the recording head moves to a recovery zone when performance of the recording head is to be recovered, the recording head moves to an image forming zone to form the image onto the recording medium, and the second inflow opening part is disposed in at least one of the recovery zone and the image forming part.

4. The image forming apparatus as claimed in claim 1, wherein the fixing part has a third inflow opening part, heat radiated from a radiation member flows in from the third inflow opening part and flows out from the discharge opening part, by heating the air stream created by the air stream creation part.

5. The image forming apparatus as claimed in claim 1, wherein a part of a flow path extending from the first inflow opening part to the discharge opening part is formed by the rail.

6. An image forming apparatus comprising:

a carriage including a recording head that discharges liquid droplets for forming an image onto a recording medium;

a rail that supports the carriage in such a manner that the carriage reciprocates;

a fixing part that fixes the rail in the image forming apparatus; and an air stream creation part that creates an air stream, wherein the fixing part is hollow, and has a first inflow opening part and a discharge opening part, and the air stream created by the air stream creation part flows from the first inflow opening part to the discharge opening part, the fixing part is disposed on a first side of the rail and the carriage is disposed on another side of the rail that is opposite to the first side on which the fixing part is disposed, the image forming apparatus further comprising:

an ejection tray onto which the recording media are stacked, wherein air discharged from the discharge opening part is discharged toward the recording media stacked on the ejection tray.

7. The image forming apparatus as claimed in claim 1, wherein the air stream creation part is disposed in the inside of the fixing part.

8. The image forming apparatus as claimed in claim 1, comprising:

a filter that filters out sub-liquid droplets that do not contribute to forming the image, wherein the filter is disposed on an upstream side of the air stream creation part.

9. The image forming apparatus as claimed in claim 1, comprising:

a filter that filters out sub-liquid droplets that do not contribute to forming the image, wherein the filter is disposed on a downstream side of the air stream creation part.

10. The image forming apparatus as claimed in claim 1, further comprising:

a position detection part that detects a position of the carriage in directions in which the rail extends, wherein the position detection part is provided in a flow path extending from the first inflow opening part to the discharge opening part.

11. The image forming apparatus as claimed in claim 10, further comprising:

a first air flow path that introduces the air stream created by the air stream creation part into the position detection part, and a second air flow path that causes the air stream having passed the first air flow path to pass through the inside of the carriage.

12. The image forming apparatus as claimed in claim 11, wherein the position detection part includes an extending part that extends along the rail and has scale information, and a detection part that moves along with the carriage along the extending part, and reads the scale information of the extending part, the first air flow path has an extending flow path part that introduces the air stream created by the air stream creation part to approximately throughout the whole length of the extending part, and the second air flow path has an inflow opening part that receives the air stream having been created by the air stream creation part, having passed through the first air flow path and then having passed through a surrounding area of the position detection part.

13. The image forming apparatus as claimed in claim 11, wherein an inflow opening part of the second air flow path, from which the air stream having been created by the air stream creation part and having passed through the first air flow path flows in, covers at least a part of the discharge opening part of the first air flow path, from which the air stream having been created by the air stream creation part and having passed through the first air flow path is discharged.

14. The image forming apparatus as claimed in claim 11, wherein the second air flow path introduces the air stream, having been created by the air stream creation part, having passed through the first air flow path and having flowed into the second air flow path, into a surrounding area of the recording head.

15. The image forming apparatus as claimed in claim 11, further comprising:

a sub-liquid droplet receiving member that receives sub-liquid droplets that do not contribute to forming the image, wherein the sub-liquid droplet receiving member is provided at a position of receiving the air stream having passed through the second air flow path.

16. The image forming apparatus as claimed in claim 11, further comprising:

a sub-liquid droplet receiving member that receives sub-liquid droplets that do not contribute to forming the image, wherein the sub-liquid droplet receiving member is provided in a replaceable manner.

17. The image forming apparatus as claimed in claim 10, further comprising:

a first air flow path that introduces the air stream created by the air stream creation part into the position detection part, wherein the air stream having passed through the first air flow path is discharged from the first air flow path, is directed by a cover of the image forming apparatus and is discharged onto a platen on which the recording head discharges the liquid droplets onto the recording medium.

18. The image forming apparatus as claimed in claim 1, further comprising:

an ejection tray onto which the recording media are stacked, wherein air discharged from the discharge opening part is discharged toward the recording media stacked on the ejection tray.

19. The image forming apparatus as claimed in claim 1, wherein the discharge opening part opens to a lower side of the image forming apparatus, and an air flow discharged from the discharge opening part points toward the lower side of the image forming apparatus.

* * * * *